US011488442B1

(12) United States Patent
Furia

(10) Patent No.: US 11,488,442 B1
(45) Date of Patent: Nov. 1, 2022

(54) PARI-MUTUEL POOL CALCULATION ENGINE ACROSS MULTIPLE PROCESSORS

(71) Applicant: Nasdaq Technology AB, Stockholm (SE)

(72) Inventor: Bryan Furia, Staten Island, NY (US)

(73) Assignee: NASDAQ TECHNOLOGY AB, Stockholm (SE)

( * ) Notice: Subject to any disclaimer, the term of this patent is extended or adjusted under 35 U.S.C. 154(b) by 0 days.

(21) Appl. No.: 17/370,588

(22) Filed: Jul. 8, 2021

(51) Int. Cl.
*G07F 17/32* (2006.01)

(52) U.S. Cl.
CPC ..... *G07F 17/3223* (2013.01); *G07F 17/3244* (2013.01); *G07F 17/3288* (2013.01)

(58) Field of Classification Search
CPC ..... G07F 17/3223; G07F 17/3244; G07F 17/3288
See application file for complete search history.

(56) References Cited

U.S. PATENT DOCUMENTS 8,275,695 B2 9/2012 Lange
2006/0205483 A1* 9/2006 Meyer ..... G06Q 20/06 463/25
2012/0058815 A1* 3/2012 Ivanov ..... G07F 17/32 463/25
2012/0302322 A1* 11/2012 Smith ..... G07F 17/3288 463/25
2015/0213684 A1* 7/2015 Daruty ..... G07F 17/3288 463/6

* cited by examiner

*Primary Examiner* — Corbett B Coburn
(74) *Attorney, Agent, or Firm* — Nixon & Vanderhye, PC

(57) ABSTRACT

The described technology relates to systems and techniques for improved utilization of a plurality of parallel processing units for processing a pari-mutuel pool. In one example, a control processor receives a plurality of wagers associated with an event associated with a pari-mutuel pool and a respective investment amount for each wager; divides the plurality of wagers to a plurality of groups, the number of groups in the plurality of groups being determined based on the number of parallel processing units in the plurality of parallel processing units; associates each group of wagers with a respective parallel processing unit of the plurality of parallel processing units; transmits each group of wagers and corresponding investment amounts to the respective parallel processing unit associated with said each group; and receives calculated odds data and/or payout amounts for each said group of wagers from the respective parallel processing units.

16 Claims, 19 Drawing Sheets

PARI-MUTUEL POOL CALCULATION ENGINE ACROSS MULTIPLE PROCESSORS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

CROSS REFERENCE(S) TO RELATED APPLICATION(S)

None.

TECHNICAL OVERVIEW

The technology described herein relates to pari-mutuel pool calculation engines, and more particularly to pari-mutuel calculation engines utilizing multiple parallel processors.

BACKGROUND

Some types of calculations, such as, for example, pari-mutuel pool calculations such as that described, for example, in U.S. Pat. No. 7,842,972, require the calculation of results associated with a set of outcomes of an event. Pari-mutuel pools are used in many different applications. Pari-mutuel wagering is one such application. In pari-mutuel wagering a wagering facilitator defines a set of fundamental outcomes for an event and accepts wagers from customers (e.g. bettors) for these outcomes. The set of fundamental outcomes exhaustively cover the entire range of outcomes for which wagers will be accepted for the pari-mutuel pool. For example, for a horse racing event with three horses 1-3, the set of fundamental outcomes, and thus the entire set of event outcomes for which wagers will be accepted, may be the entire range of possibilities covering the first and second placed horses. A wager placed by a customer can include bets on just one fundamental outcome or any combination of the possible fundamental outcomes in the set of possible outcomes for an event.

Some events may have a large set of possible fundamental outcomes, which may result in a very large number of combinations of those fundamental outcomes. Additionally, such events may have a very large number of customers that each submits one or more wagers. The large number of fundamental outcomes, their combinations, and the even larger number of wagers lead to challenging computation requirements for determining the odds and payouts for the wagers. Some example techniques that are presently used to calculate the odds and payouts for pari-mutuel wagering are described in U.S. Pat. No. 7,842,972 dated Jun. 22, 2010 and U.S. Pat. No. 8,275,695 dated Sep. 25, 2012, the entire contents of both of which are herein incorporated by reference.

In view of the wide range of types of tasks or events for which techniques similar to pari-mutuel wagering are applicable and in view of the desire for faster and more efficient computations of results of pari-mutuel pool calculations for wagering and the like, improved systems and methods are desired.

SUMMARY

The described technology relates to systems and techniques for calculating pari-mutuel pools while utilizing multiple processors with improved efficiency to speed up obtaining results based on the pari-mutuel pools and to support increases pool sizes.

An embodiment provides a system comprising a control processor and a plurality of parallel processing units communicatively connected to the control processor, with each parallel processing unit comprising a graphics processing unit (GPU). The control processor is configured to: obtain, from message data received from a requesting device, an opening bet data structure comprising a plurality of opening bets, the plurality of opening bets comprising a respective opening bet on each outcome of an event having a plurality of outcomes; store one or more wager data structures in a memory, the one or more wager data structures comprising a plurality of wagers associated with the event and a respective investment amount for each wager of the plurality of wagers in a pari-mutuel pool; and divide the plurality of wagers to a plurality of groups of wagers, the number of groups in the plurality of groups of wagers being determined based on the number of parallel processing units in the plurality of parallel processing units, wherein the dividing includes allocating non-adjacent groups of sequentially arranged groups of one or more wagers from the one or more wager data structure to respective groups of the plurality of groups of wagers.

The control processor is further configured to: associate each group of wagers of the plurality of groups of wagers with a respective parallel processing unit of the plurality of parallel processing units; broadcast the opening bet data structure to the plurality of parallel processing units; unicast data comprising respective groups of the plurality of groups of wagers and the corresponding investment amounts to each of said parallel processing units; receive at least one of odds data or payout amounts for each said group of wagers from the respective parallel processing units; generate a response based on the received at least one of odds data or payout data; and transmit the generated response to the requesting device.

An embodiment provides a method performed on each parallel processing unit of a plurality of parallel processing unit in a system comprising a control processor and the plurality of parallel processing units. The method comprises: obtaining, from message data received from a requesting device, an opening bet data structure comprising a plurality of opening bets, the plurality of opening bets comprising a respective opening bet on each outcome of an event having a plurality of outcomes; storing one or more wager data structures in a memory, the one or more wager data structures comprising a plurality of wagers associated with the event and a respective investment amount for each wager of the plurality of wagers; and dividing the plurality of wagers to a plurality of groups of wagers, the number of groups in the plurality of groups of wagers being determined based on the number of parallel processing units in the plurality of parallel processing units, wherein the dividing includes allocating non-adjacent groups of sequentially arranged groups of one or more wagers from the one or more wager data structure to respective groups of the plurality of groups of wagers.

The method further includes: associating each group of wagers of the plurality of groups of wagers with a respective parallel processing unit of the plurality of parallel processing units; broadcasting the opening bet data structure to the plurality of parallel processing units; unicasting data comprising respective groups of the plurality of groups of wagers and the corresponding investment amounts to each of said parallel processing units; receiving at least one of odds data or payout amounts for each said group of wagers from the respective parallel processing units; generating a response based on the received at least one of odds data or payout data; and transmitting the generated response to the requesting device.

An embodiment provides a non-transitory computer readable storage medium having stored instructions that, when executed by a control processor of a system for processing a pari-mutuel pool associated with an event, cause the control processor to perform operations comprising: obtaining, from message data received from a requesting device, an opening bet data structure comprising a plurality of opening bets, the plurality of opening bets comprising a respective opening bet on each outcome of an event having a plurality of outcomes; storing one or more wager data structures in a memory, the one or more wager data structures comprising a plurality of wagers associated with the event and a respective investment amount for each wager of the plurality of wagers; and dividing the plurality of wagers to a plurality of groups of wagers, the number of groups in the plurality of groups of wagers being determined based on the number of parallel processing units in a plurality of parallel processing units, wherein each parallel processing unit is connected to the control processor and comprises a graphics processing unit (GPU), and wherein the dividing includes allocating non-adjacent groups of sequentially arranged groups of one or more wagers from the one or more wager data structure to respective groups of the plurality of groups of wagers.

The instructions further cause the control processor to perform: associating each group of wagers of the plurality of wagers with a respective parallel processing unit of the plurality of parallel processing units; broadcasting the opening bet data structure to the plurality of parallel processing units; unicasting data comprising respective groups of the plurality of groups of wagers and the corresponding investment amounts to each of said parallel processing units; receiving at least one of odds data or payout amounts for each said group of wagers from the respective parallel processing units; generating a response based on the received at least one of odds data or payout data; and transmitting the generated response to the requesting device.

This summary is provided to introduce a selection of concepts in a simplified form that are further described below in the Detailed Description. This Summary is intended neither to identify key features or essential features of the claimed subject matter, nor to be used to limit the scope of the claimed subject matter; rather, this Summary is intended to provide an overview of the subject matter described in this document. Accordingly, it will be appreciated that the above-described features are merely examples, and that other features, aspects, and advantages of the subject matter described herein will become apparent from the following Detailed Description, Figures, and Claims.

DETAILED DESCRIPTION

In the following description, for purposes of explanation and non-limitation, specific details are set forth, such as particular nodes, functional entities, techniques, protocols, etc. in order to provide an understanding of the described technology. It will be apparent to one skilled in the art that other embodiments may be practiced apart from the specific details described below. In other instances, detailed descriptions of well-known methods, devices, techniques, etc. are omitted so as not to obscure the description with unnecessary detail.

Sections are used in this Detailed Description solely in order to orient the reader as to the general subject matter of each section; as will be seen below, the description of many features spans multiple sections, and headings should not be read as affecting the meaning of the description included in any section.

Overview

The technology described herein relates to, among other subjects, improving the performance of, and supporting larger pool sizes in, pari-mutuel pool calculation for wagering and other applications in which sparse matrix multiplication with vectors is used. As noted above, with events for which pari-mutuel pools are formed having increasing numbers of outcomes and increasing numbers of wagers on the outcomes, the magnitude of calculations necessary to determine the odds and/or payout values associated with the respective wagers are constantly increasing and present challenges in terms of timeliness and computation capacity. The technology described in this application, provides for efficiently utilizing multiple parallel processing resources available in each computer system to perform the pari-mutuel pool calculations using one or more computer systems in a faster, more scalable, manner.

Figure 1:
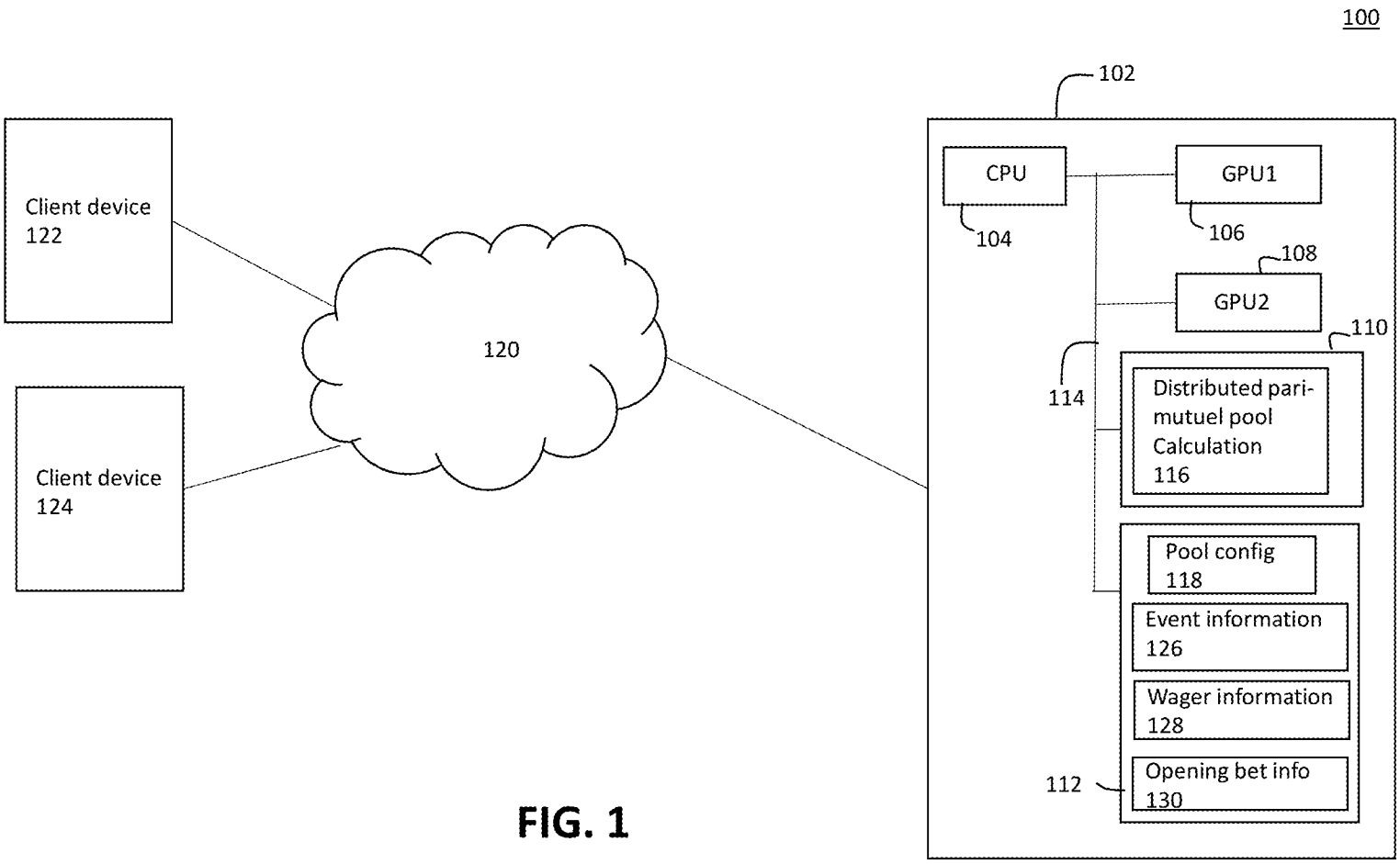
FIG. 1 illustrates an example computing environment including a computer system having a pari-mutuel computation engine, according to some example embodiments.
Figure 2:
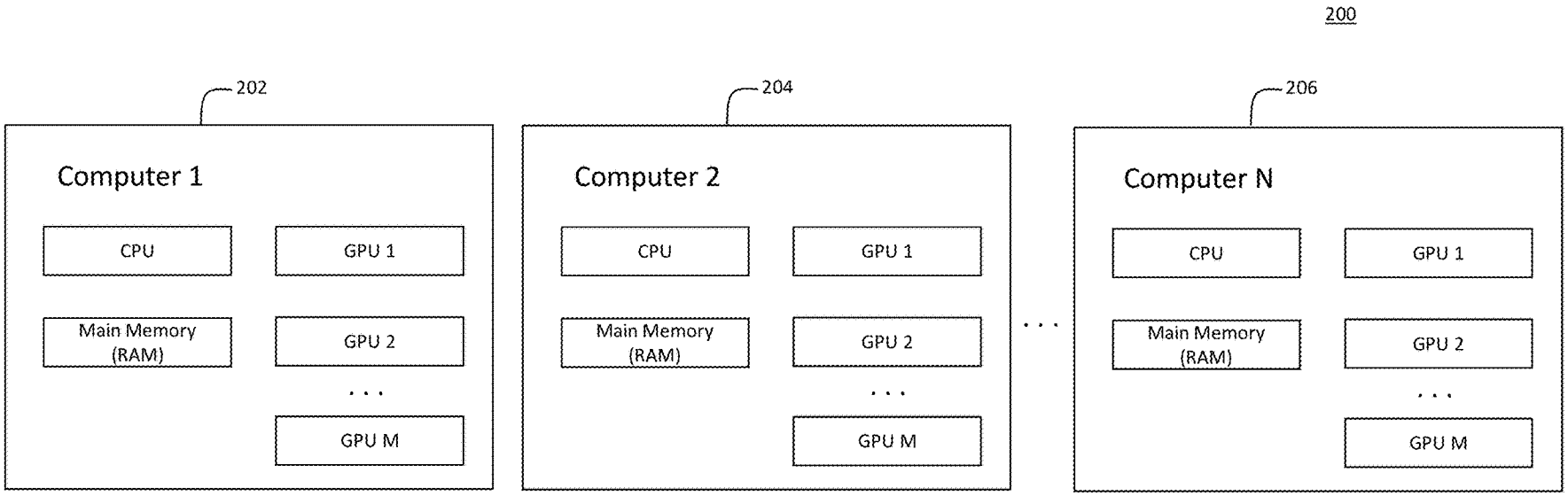
FIG. 2 shows another computer system configuration that can be used for the pari-mutuel computation engine, according to some example embodiments.

FIG. 1 illustrates an example computing environment including a computer system having a pari-mutuel calculation engine (CE), according to some example embodiments. The computer system of FIG. 1 comprises one computer having multiple parallel processing resources (e.g. graphics processing units or GPUs) to which the pari-mutuel computation can be distributed for improved speed and scalability. FIG. 2 shows another computer system that can be used for the pari-mutuel CE, according to some example embodiments. The computer system of FIG. 2 comprises multiple computers each of which has at least one parallel processing resource. FIG. 3 illustrates a software architecture for a pari-mutuel CE that can be run in the computer systems of FIG. 1 or FIG. 2. The software architecture provides for one control process and one or more worker processes that associate with respective parallel processing resources, thereby enabling respective parts of the calculation to be assigned to each available computer and/or parallel processing resource that may perform the parts of the calculation individually and then collaborate to complete the entire calculation and return results.

Figure 3A:
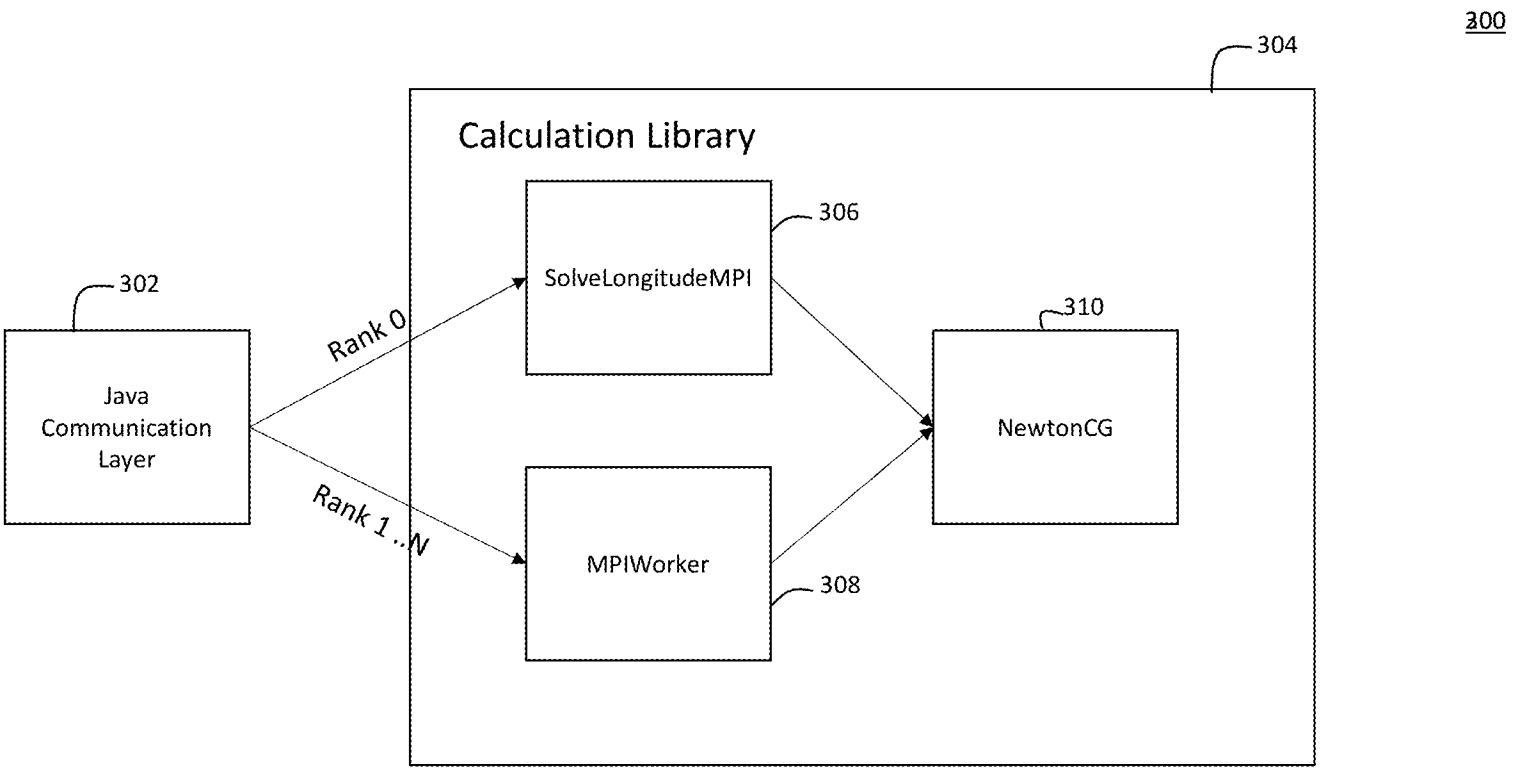
FIG. 3A and FIG. 3B (collectively FIG. 3) illustrate architectures for a pari-mutuel calculation engine, according to some example embodiments.
Figure 3B:
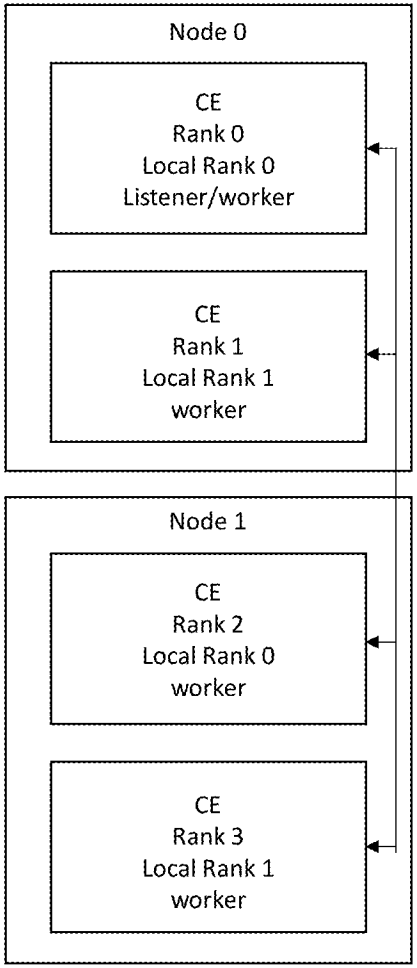
Figure 4A:
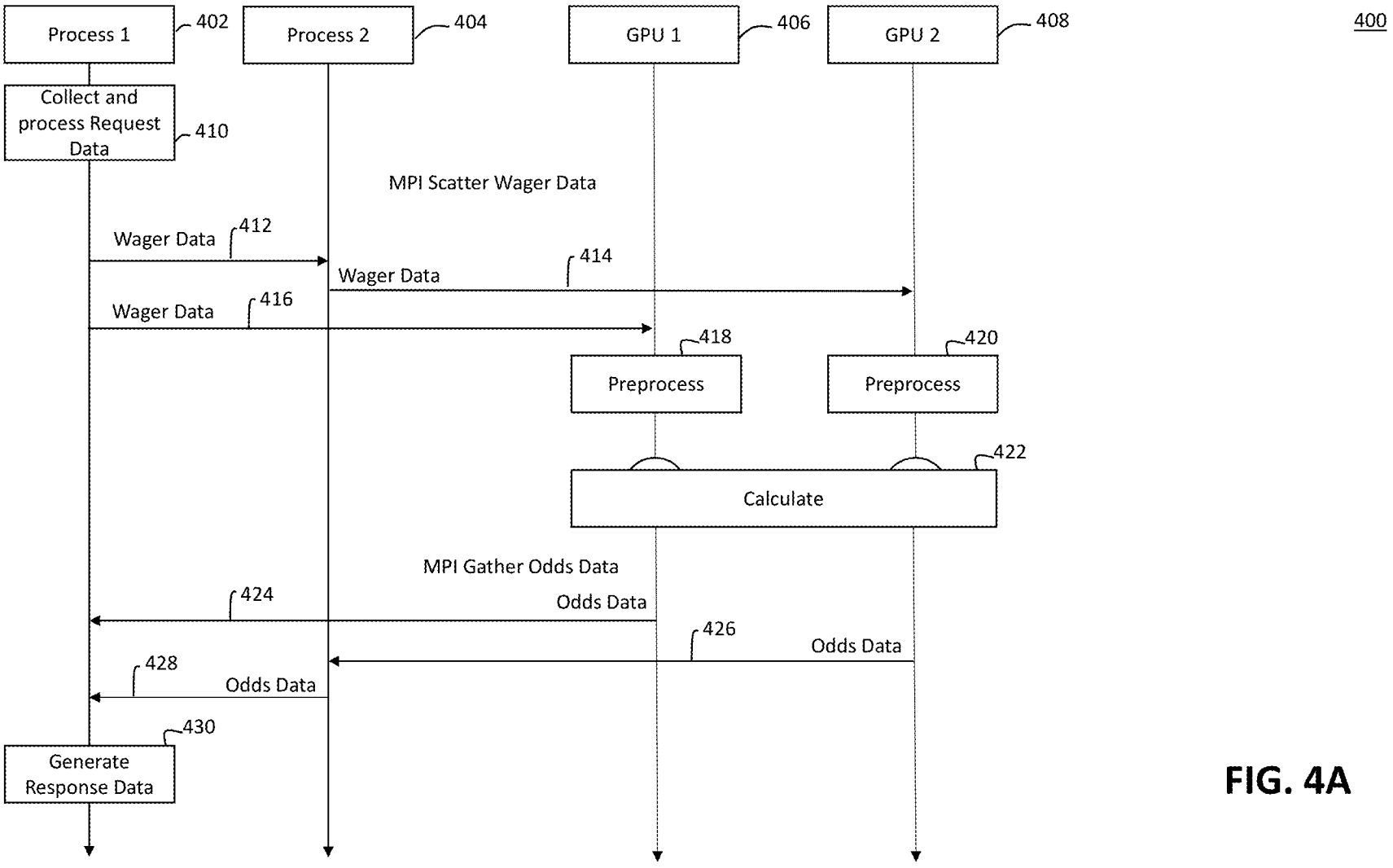
FIG. 4A shows a flow diagram for a sequence of interactions of a pari-mutuel pool calculation process performed by a plurality of processes and a plurality of parallel processing resources, according to some example embodiments.
Figure 4B:
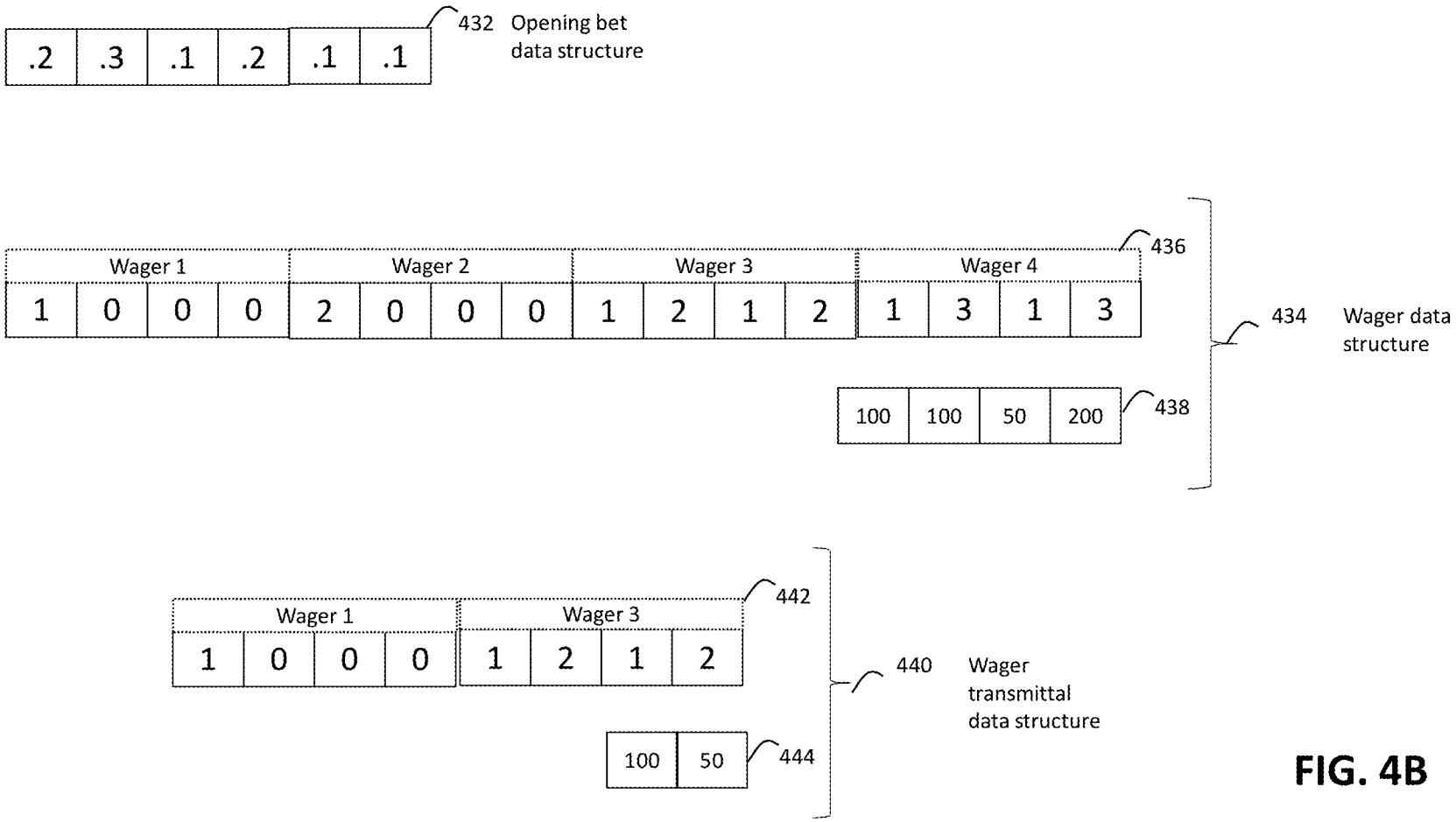
FIG. 4B shows example data structures that may be used by a control process, according to some example embodiments.
Figure 5:
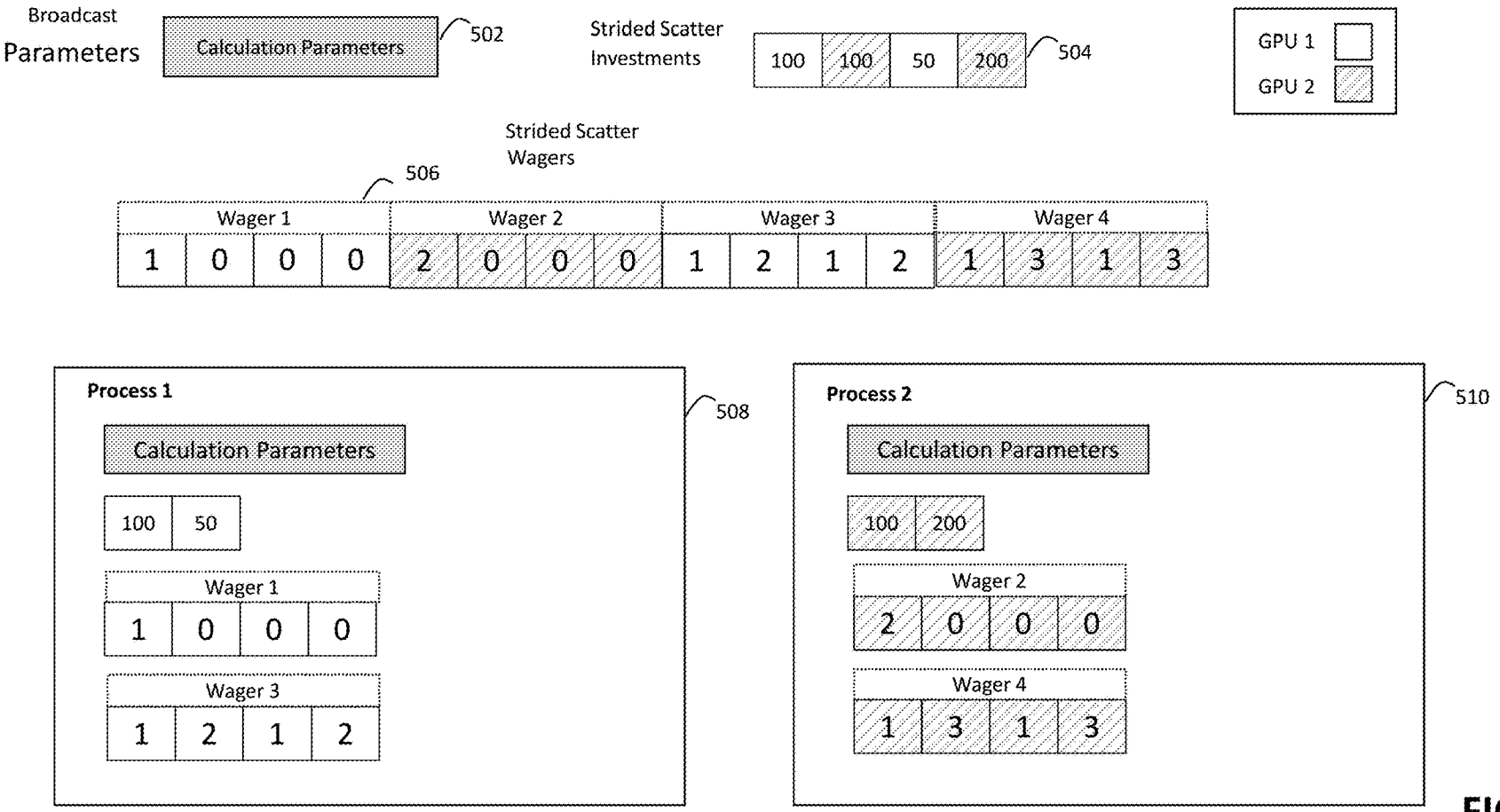
FIG. 5 illustrates an example of information provided by the control process to the parallel processing resources for use in the pari-mutuel pool calculation, according to some example embodiments.
Figure 6:
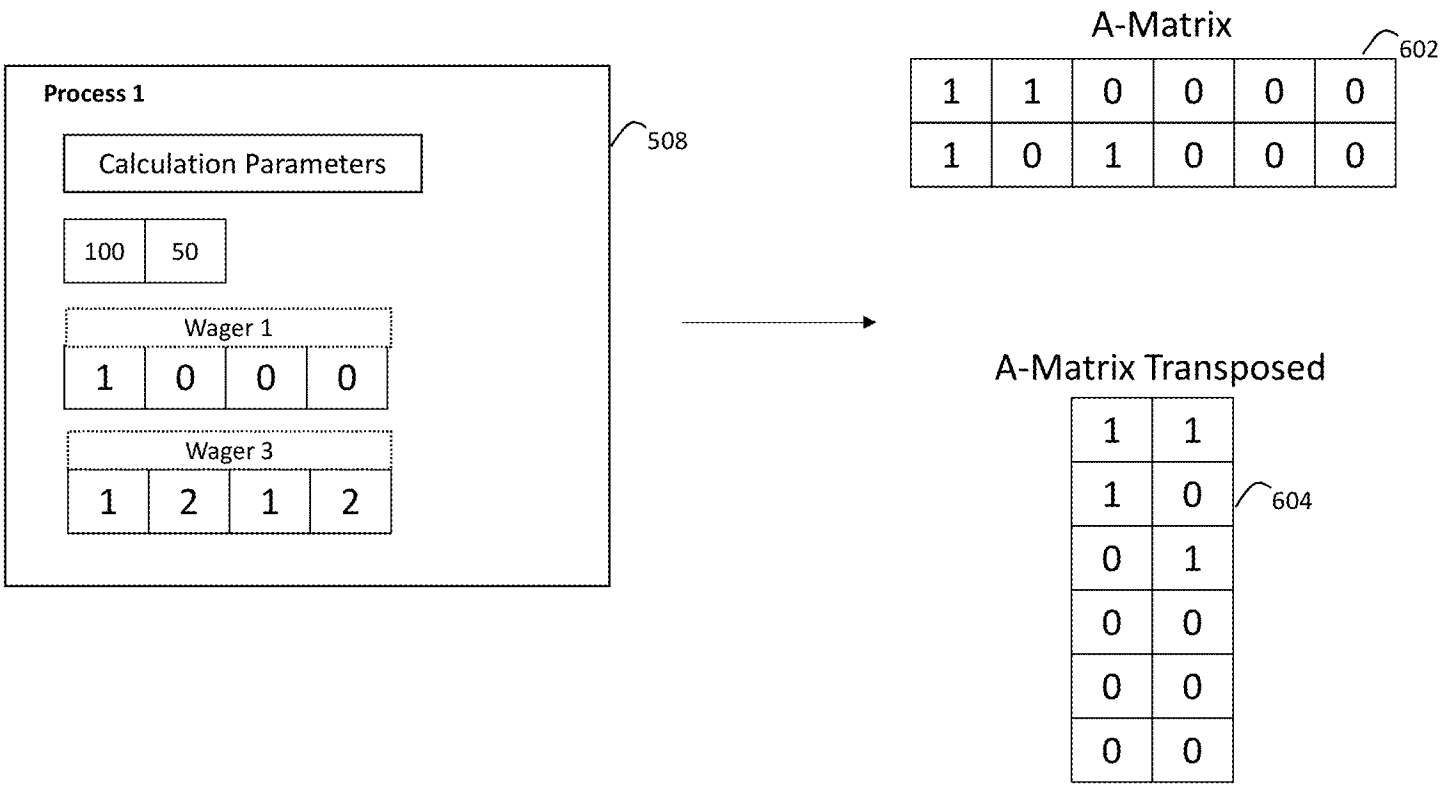
FIG. 6 illustrates an example of preprocessing performed on received wager information and other information by processes associated with the parallel processing resources, according to some embodiments.

FIG. 4 shows a sequence of interactions of an example pari-mutuel pool calculation process performed by a plurality of processes and a plurality of parallel processing resources that may be arranged in accordance with the software architecture shown in FIG. 3 and executed in a computer system shown in FIG. 1 or FIG. 2. The calculation process shown in FIG. 4A takes event information and wager information as input arranged in memory as shown for example in FIG. 4B, and outputs odds information and/or anticipated payout amounts for the outcomes of the event. FIG. 5 illustrates example of input information provided by the control process to the parallel processing resources for use in the pari-mutuel pool calculation, according to some example embodiments. FIG. 6 illustrates an example of preprocessing performed on received input information such as the wager information by processes associated with the parallel processing resources.

Figure 7:
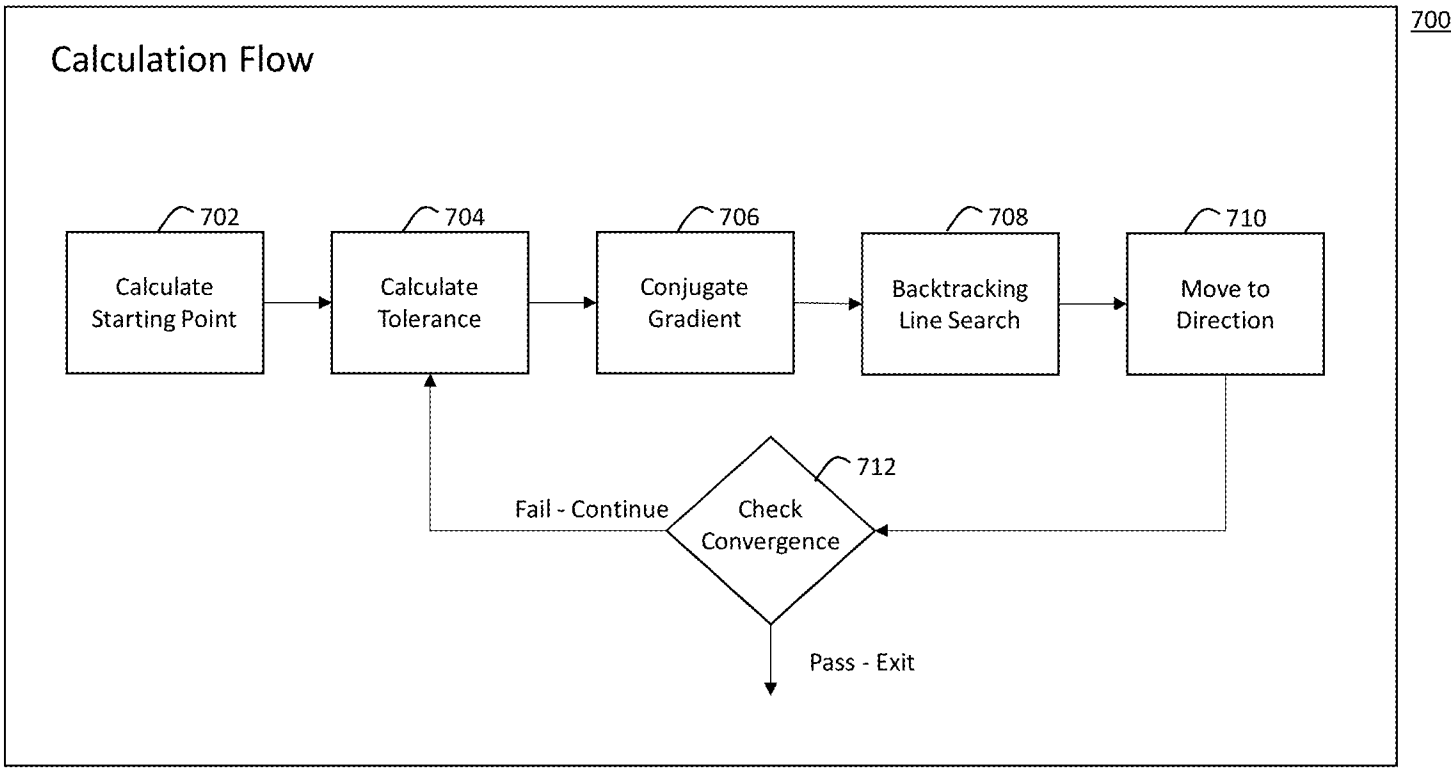
FIG. 7 illustrates an example calculation process that is performed by the parallel processing resources based on the preprocessed input information to generate results including odds information and payout information in the pari-mutuel pool calculation process shown in FIG. 4, according to some embodiments.
Figure 9A:
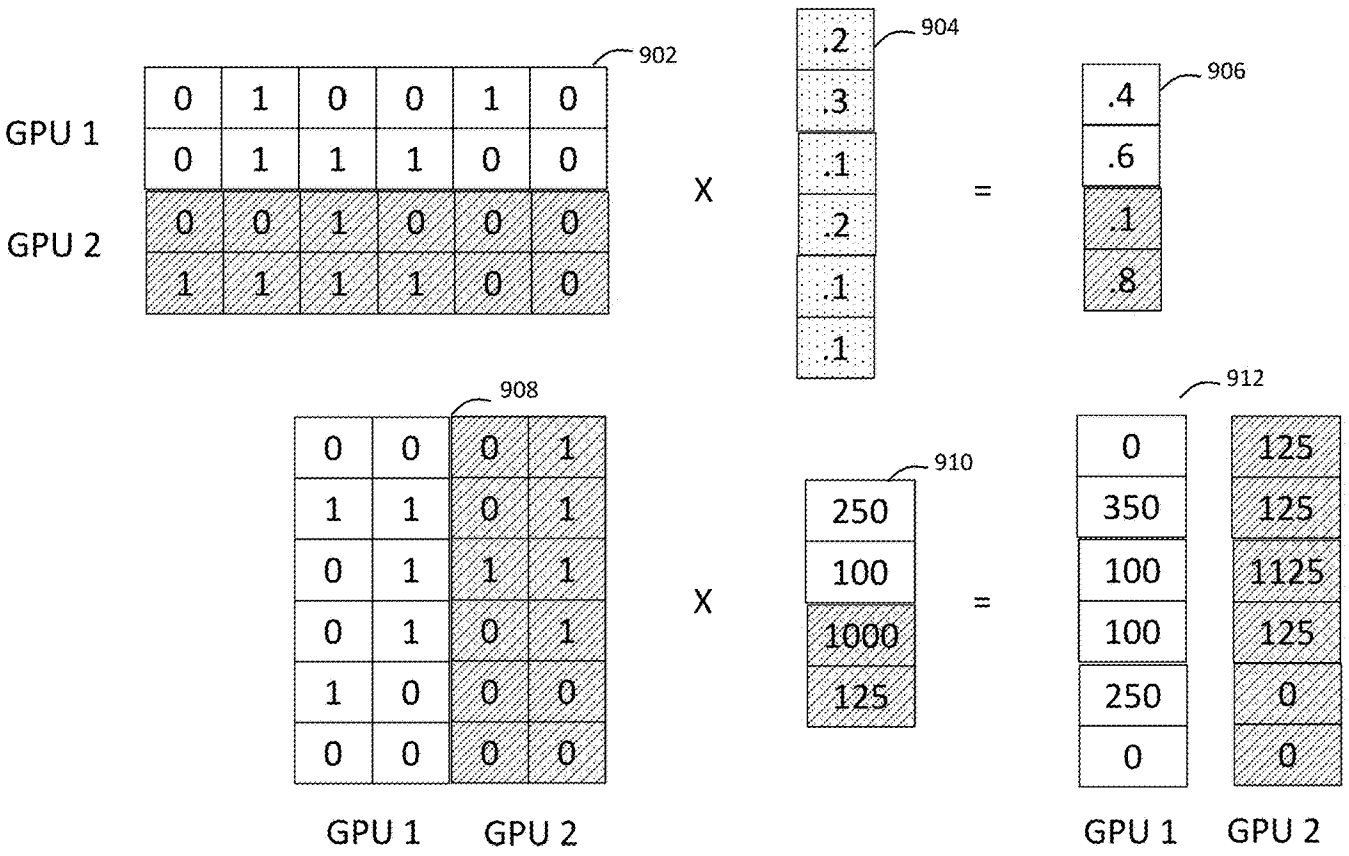
FIG. 9A, FIG. 9B and FIG. 9C (collectively FIG. 9) illustrate an example of matrices and vectors representing the input information, and example uses of such matrices and vectors during the starting point calculation, according to some embodiments.
Figure 9B:
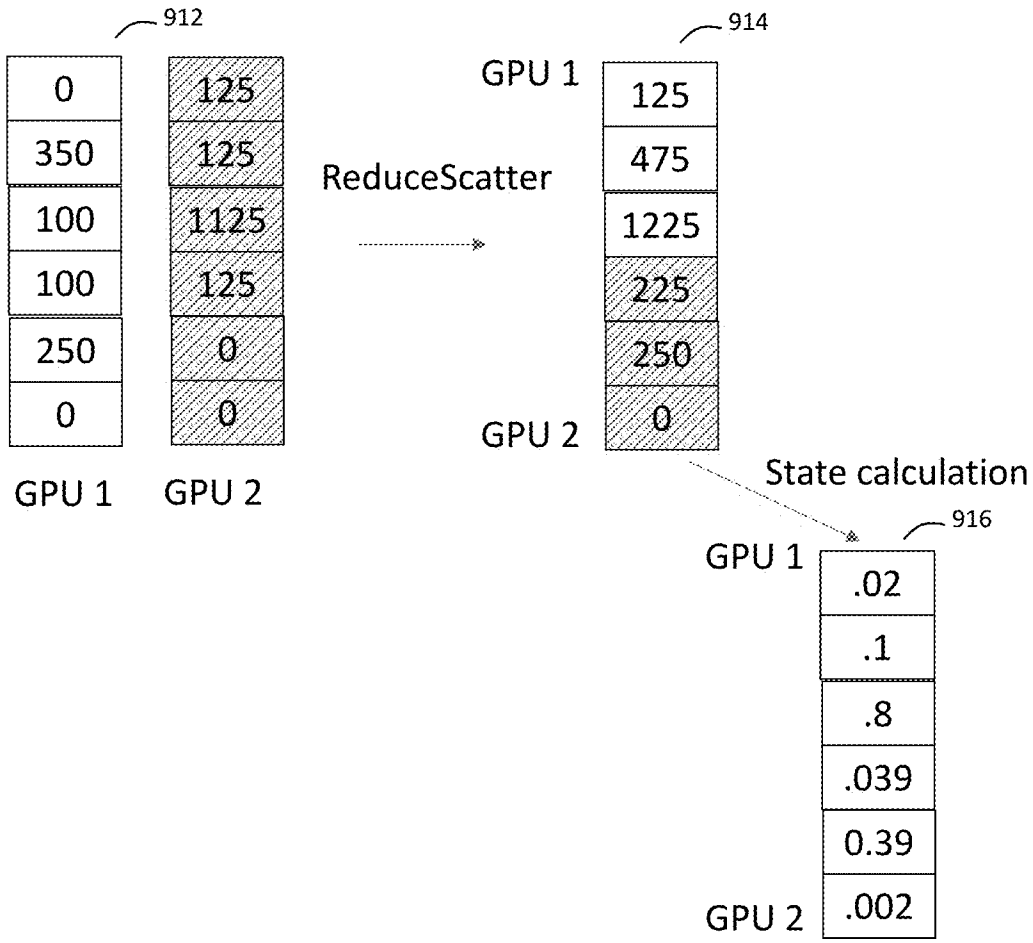
Figure 9C:
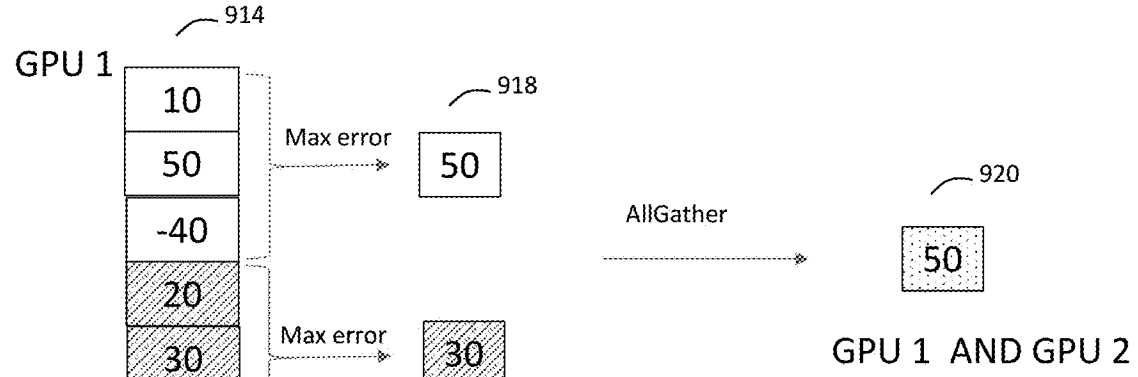
Figure 10:
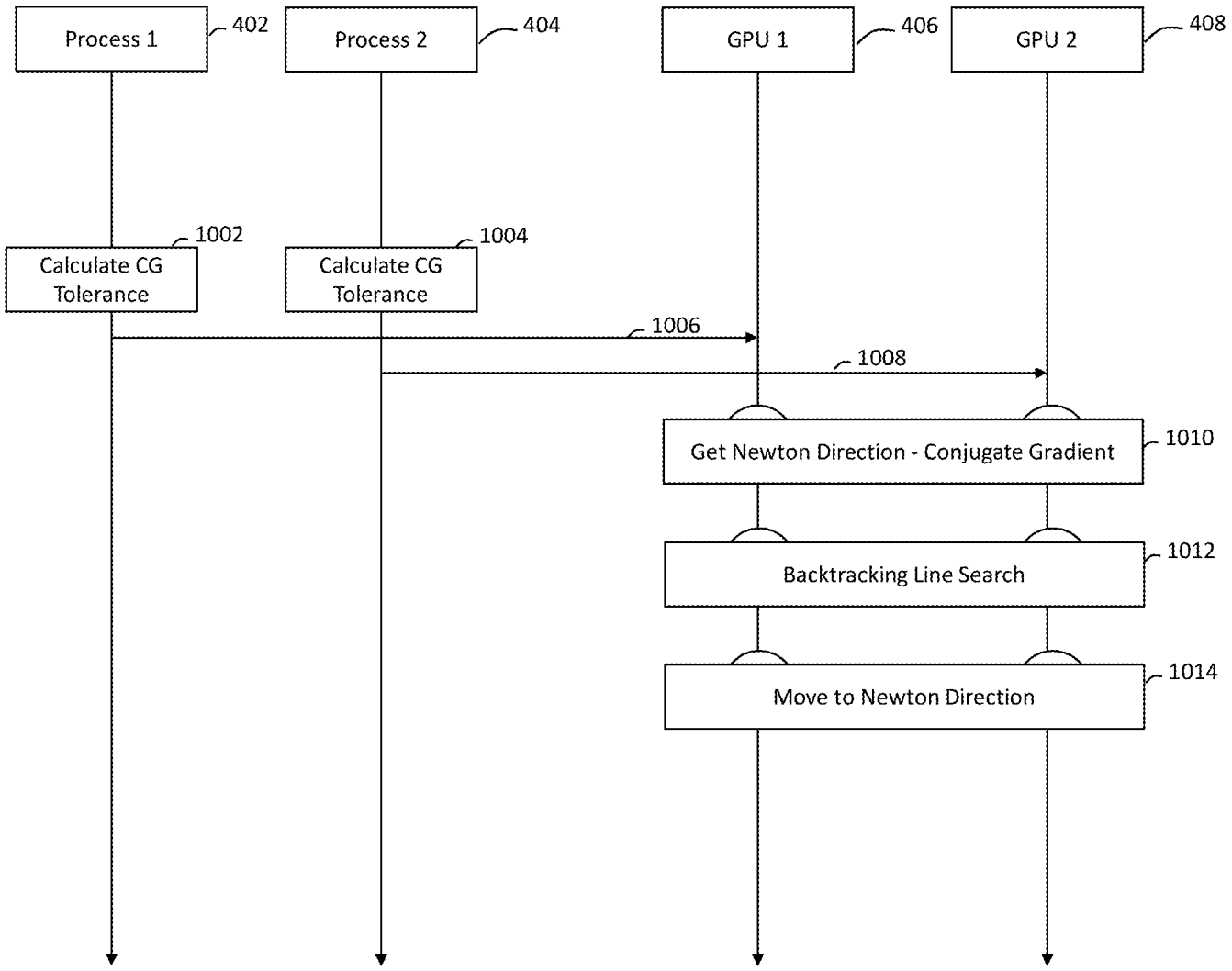
FIG. 10 illustrates a Newton Conjugate Gradient (Newton CG) iteration process used in the calculation shown in FIG. 7, in accordance with some embodiments.
Figure 11:
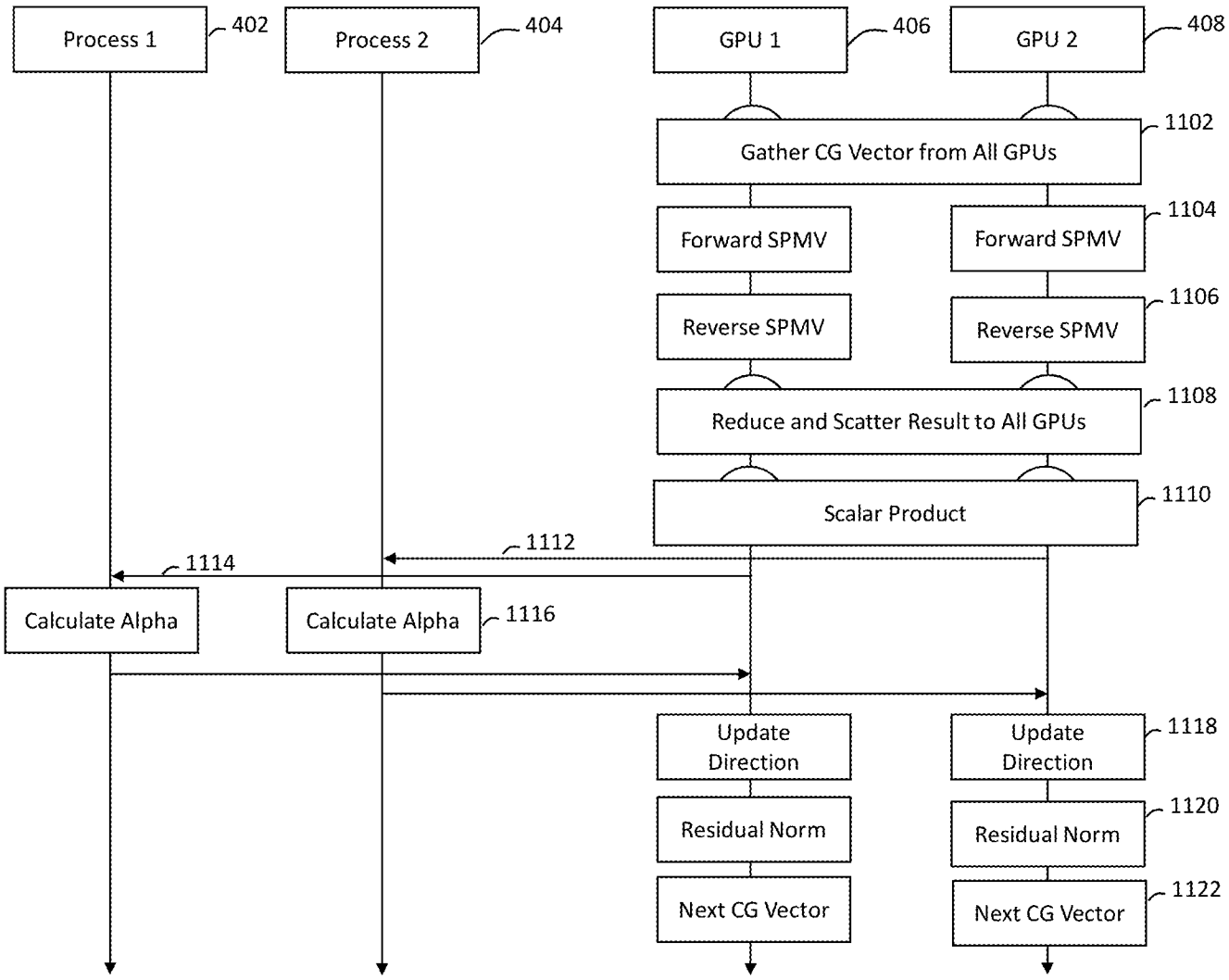
FIG. 11 illustrates a conjugate gradient direction process used in the process shown in FIG. 10, in accordance with some embodiments.
Figure 12:
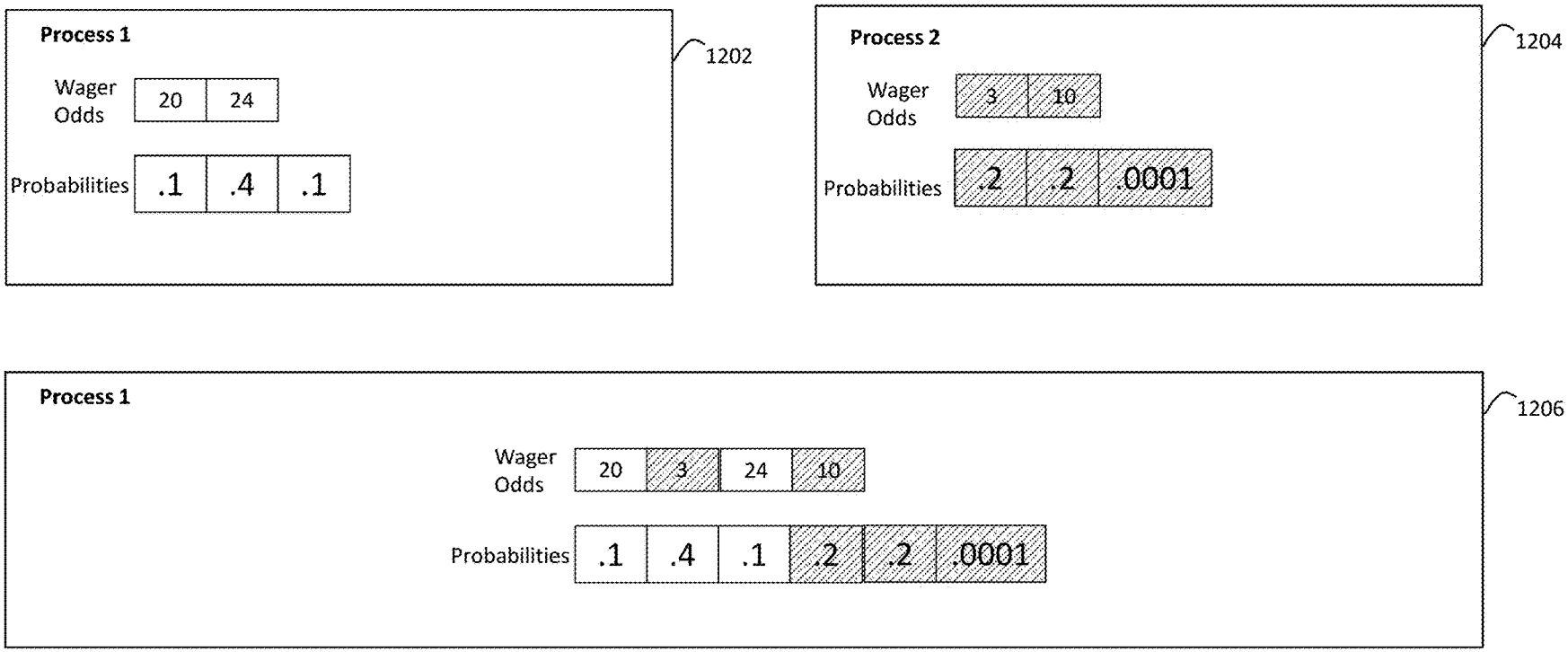
FIG. 12 illustrates an example of results from the pari-mutuel pool calculation process shown in FIG. 4, in accordance with some embodiments.

FIG. 7 illustrates an example calculation process that is performed by the parallel processing resources and associated processes based on the preprocessed input information to generate results including odds information and payout information in the pari-mutuel pool calculation process shown in FIG. 4. The starting point calculation of FIG. 7 which is used to determine initial results for the calculation, is shown in more detail in FIG. 8. FIG. 9A, FIG. 9B and FIG. 9C illustrate example matrices and vectors representing input information, and example uses of such matrices and vectors during the starting point calculation, according to some embodiments. FIG. 10 illustrates the Newton Conjugate Gradient (Newton CG) iteration process shown in FIG. 7, in more detail. FIG. 11 illustrates a conjugate gradient direction process used in the process shown in FIG. 10. FIG. 12 illustrates an example of the results from the pari-mutuel pool calculation process shown in FIG. 4A.

FIG. 13 illustrates examples of the performance improvements provided by some embodiments. FIG. 14 schematically illustrates an example computing device that can be used, according to some embodiments, to implement the features described with reference to FIG. 1 through FIG. 12.

The embodiments described in detail in this disclosure relate to pari-mutuel pools for use in applications such as, for example, electronic wagering. Although such applications may use the teachings in this disclosure with particular advantage to speed up the performance and to provide for handling large data sets, embodiments are not limited to the computer environments or applications specifically described herein.

Description of FIG. 1

FIG. 1 illustrates an example computing environment 100 including a computer system having a pari-mutuel calculation engine, according to some example embodiments. The computer system of FIG. 1 comprises one computer 102 that has multiple parallel processing resources (e.g. graphics processing units (GPU) 106 and 108) to which the pari-mutuel computation 116 can be distributed for improved efficiency and speed.

The computer system that performs the pari-mutuel pool calculation in the computing environment 100 comprises computer 102. Computer 102 may be provided and/or controlled by a wagering association or other wagering facilitator that provides or facilitates the capability for customers (e.g. bettors) to place wagers on a particular event's set of fundamental outcomes and to receive payouts based on the results associated with the placed wagers. A wager, as used herein, is a bet placed by a customer on one or more fundamental outcomes of the event, and is associated with an investment specified in terms of value units. A payout is an amount in value units (e.g. dollars or other currency) to be paid to a wager (actually to the customer associated with the wager) based on the one or more fundamental outcomes bet on in the wager.

The computer 102 includes at least one control processor 104, which may be a central processing unit (CPU), and a plurality of parallel processing resources (also referred to as parallel processing units) communicatively connected via a network 114. The parallel processing resources include the graphics processing units (GPU) 106 and 108. Parallel processing resources are not limited to GPUs, and may include other types of parallel processors that can efficiently perform single instruction multiple data (SIMD) and/or single instruction multiple thread (SIMT) processing. The control processor and the parallel processing resources access a memory 110, such as a random access memory or other volatile memory for instructions and data. The control processor may also have access to a digital storage device 112, such as a hard drive or other persistent (non-volatile) memory.

The control processor 104 operates to execute a distributed pari-mutuel pool calculation 116 using the plurality of available parallel processing resources. The pari-mutuel pool calculation 116 utilizes input information such as event information 126, wager information 128, and opening bet information 128 stored on digital storage device 112. The control processor 104 may also access pool configuration information 118 in the digital storage device 112. The distributed pari-mutuel pool calculation 116 provides a pari-mutuel calculation engine that allows a single calculation to be distributed across multiple parallel processing resources such as, for example, GPUs, by logically splitting the calculation across the multiple parallel processing units. In some embodiments, communication between multiple GPU is provided using the NCCL™ framework, and CUDA™-aware MPI™ which provides support for directly transferring data on the GPU without having to transfer the data to the host processor (e.g. CPU).

One or more client devices may interact with the computer 102 over a network 120, such as, for example, the internet or a local network, for performing tasks associated with pari-mutuel pool calculation. Client devices 122 and 124 may each be operated by a respective customer, or the same customer, to place wagers and/or to receive the results of the placed wagers.

Although a computer system with one computer 102 is illustrated in the computing environment 100 shown in FIG. 1, in some embodiments, the computer system may include more than one computer 102 interconnected by an interconnection infrastructure such as one or more system buses and/or local networks. Moreover, although two client devices are shown in FIG. 1, the computing environment 100 may include any number of clients and/or client devices that access the pari-mutuel tasks on computer 102. The client devices 122 and 124 may connect to the server system via local area network or wide area network.

The distributed pari-mutuel pool calculation 116 performed on computer 102 may be part of, or may be initiated by, a server process such as a web server. For example, the web server may interact with browsers and/or other applications on the client devices 122 and 124 to receive wagers and to transmit results of such wagers via HTTP messages. In some embodiments, the pari-mutuel pool calculation may operate in association with an electronic wagering application. The code for the pari-mutuel pool calculation application 116 during execution may at least partially exist in memory 110, and may be stored in the memory 110 and/or digital storage device 112.

Client devices 122 and 124 may include any of personal computers, mobile computers, tablets, smartphones, and other electronic devices. In some example embodiments, any electronic computing device including at least a display, an input device for user input, and a communication interface for communicating with the server device may operate as a client device.

Computer 102 may be additionally configured, or associated with another one or more computers, for backend services. The backend services includes, for example, authentication, user configurations, security, credentials etc. The backend services may also provide for user and/or application session maintenance and the like.

In some embodiments, the computer 102, utilizing backend services, may also interact with one or more external servers, such as, for example, for receiving streamed or downloaded event, securities and/or trading information. Where the computer system of the computing environment 100 includes a server system of more than one computer 102 on which the pari-mutuel pool calculation is distributed, the server system may include one or more physical server computers that are communicatively connected to each other over a network and/or point-to-point connections. The physical server computers may be geographically co-located or distributed. The interconnection between servers in computer system may be via the Internet or over some other network such as a local area network, a wide area network or point-to-point connections (not separately shown) with each other. In some embodiments, multiple servers are interconnected with high speed point-to-point connections and/or a high speed broadcast bus. Each physical server in the server system 102 includes a processing system having at least one uni- or multi-core processor and includes system software. In some embodiments, each physical server may correspond to a processing unit in a Symmetric Multiprocessor (SMP). In some embodiments, each physical server may be standalone computer interconnected to one or more other computers with a high speed connection. In some embodiments, a server corresponds to a server process running on one or more physical computers.

It should be understood that the software modules shown in FIG. 1 are stored in and executed by hardware components (such as processors and memories), and it should be further understood that, whenever it is described in this document that a software module performs any action, that is done solely for ease of description, and the action is in actuality performed by the underlying hardware elements (such as a processor and a memory device) according to the instructions and data that comprise the software module. Further details regarding example hardware components that may be used to implement the features described herein are provided below with reference to FIG. 14, as well as elsewhere in this document.

Description of FIG. 2

FIG. 2 shows another computer system that can be used for the pari-mutuel computation engine, according to some example embodiments. The computer system of FIG. 2 comprises multiple computers each of which has at least one parallel processing resource.

The computer system 200 shown in FIG. 2 may include N computers where N is any integer that is 2 or greater. The illustrated computer 1, computer 2 and computer N (identified as 202, 204 and 206) are merely exemplary. Each of the computers 202-206 may have a control processor and one or more parallel processing resources. For example, each computer 202-206 is illustrated as having a GPUs 1 . . . M, where M is any integer 1 or greater. Each computer 202-206 may be computer such as computer 102 shown in FIG. 1 or the computing device shown in FIG. 14. Point-to-point connections, one or more local area networks, and/or one or more other networks may interconnect the computers of computer system 200.

A pari-mutuel pool calculation, such as the pari-mutuel calculation 116, may be performed on the computer system 200 utilizing any group of the available computers 1 . . . N and any number of GPUs 1 . . . M in each utilized computer. In an example implementation, the CPU of the computer 1 may control the execution of the par-mutuel calculation 116, by distributing portion of the calculation among the parallel processing resources available in the computing system. For example, the CPU of computer 1, may distribute respective portions of the calculation to one or more GPUs in each of the computers 1 . . . N. Whereas the CPU of computer 1 may directly communicate with the GPUs on computer 1, communication with GPUs on computers 2 . . . N involves the exchange of messages between the CPU of computer 1 and the CPUs of computer 2 . . . N over the interconnection infrastructure that interconnects the computers 1 . . . N.

Description of FIG. 3 (FIGS. 3A and 3B)

FIG. 3A illustrates a software architecture for a pari-mutuel calculation engine according to some example embodiments. The software architecture provides for the respective parts of the computation to be assigned to each available computer and/or parallel processing resource that may perform the parts individually and then collaborate to complete the computation and to output results. For example, the software architecture 300 illustrates an implementation architecture of the pari-mutuel pool calculation 116 according to some embodiments.

The processing and calculations of the pari-mutuel pool calculation 116 may be contained one or more programs in a calculation library 304. A Java™ communication layer 302 distributed over each of the computers performing the computation provides for a control process 306 to be executed on the control processor of at least one of the computers, and a worker process 308 to be executed on each of the computers providing parallel processing resources.

In an example embodiment, a parallel computation framework such as MPI™ may be used to initiate the control process 306 on computer 1 shown in computer system 200 ("Rank 0" in this example) and the worker process 308 on each the computers 2 . . . N ("Rank 1 . . . N" in this example) in computer system 200. The portions of the pari-mutuel pool calculation 116 performed by the control process 306 and worked processes 308 may use the same program code 310 during the calculation in order to obtain the final results of the calculation.

FIG. 3B illustrates a hardware and software architecture in which software processes of the calculation engine (CE) providing the pari-mutuel calculation process 116 in a computer system comprising two computers (Node 0 and Node 1) each having two GPUs. As shown, in this configuration, each computer has two CE processes.

Only 1 process, identified as Rank 0, is configured as a listener to receive connections and requests for the CE. The connections, or more particularly commands and/or requests, may be received over the TCP protocol by the Rank 0 process. The other processes, Rank 1-3 processes, will be waiting for Rank 0 to join the MPI collective calls. The Rank 0 process will then broadcast and scatter request data to the CE processes and Gather the output when the calculation is complete.

To initialize the CE in the computer system, a root process creates an NCCL unique ID and uses MPI to broadcast the unique ID to processes for Rank 0 and other ranks, each of which creates a NCCL communicator associated with the received unique ID. Each of the CE processes execute on the CPU with each CE process being associated with a respective one of the GPUs. The CUDA framework or the like can be used to associate a process, which executes on the CPU, with a GPU.

Description of FIG. 4 (collectively FIGS. 4A and 4B)

FIG. 4A illustrates an example flow diagram showing a sequence of interactions of a process 400 performed by a plurality of processes and a plurality of parallel processing resources in a computer system in order to perform pari-mutuel pool calculation, according to an example embodiment. As described in this disclosure pari-mutuel pools may be used in various applications. In the description of the processes shown in FIGS. 4A, 7, 8, 11 and 12, a wagering application of pari-mutuel pools is described. However, embodiments are not limited to wagering systems.

In an example pari-mutuel wagering system implemented on the computer system of FIG. 1 or FIG. 2, using the software architecture of FIG. 3A and/or FIG. 3B, the wagering association may set a time period to receive wagers before an event. The wagering association may periodically determine the odds and optionally the payouts associated with the received wagers even before the time period for receiving wagers ends and a final set of payouts and/or odds are calculated for the wagers. According to some embodiments, process 400 may be used for an iteration of calculating payouts and/or odds.

Process 400 may be initiated by computer 102 in FIG. 1 or computer 1 in FIG. 2, in response to event information (e.g. set of fundamental events, pool configuration), wager information (e.g. wagers from bettors), and opening bet information (e.g., a nominal value amount specified per fundamental outcome) received from an internal process or from a message received from a client device (such as, for example, client devices 122 or 124) or another computer device of the wagering association administering the computer 102 of FIG. 1 and/or computer 1 of FIG. 2. In some embodiments, process 400 may be internally triggered based on a timer expiry and/or based on a predetermined set of conditions such as a number of wagers having been received.

In the illustrated example, process 1 (402) is the control process executing on the control processor, and GPU 1 (406) is collocated in the same computer as the control processor. Process 2 (404) is collocated in the same computer with the GPU 2 (408).

If process 400 were to execute in the computer system of FIG. 1, then, since the computer system has a single computer 102 with one CPU and two GPUs, processes 402 and 404 both execute on CPU 104 with process 402 operating as the control process. GPUs 406 and 408 may correspond to GPUs 106 and 108, respectively. Processes 402 and 404 may be programmatically associated with GPUs 406 and 408, respectively. The programmatic association enables process 402 to utilize GPU 406 for selected portions of its computations and for process 404 to utilize 408 for selected portions of its computations.

On the other hand, if process 400 were to execute on the computer system of FIG. 2 with multiple computers, then, process 402 and GPU 406 may be in computer 202, and process 404 and GPU 408 may be in computer 204.

After starting process 400, at operation 402, the control process 402 collects request data. After receiving and/or gathering to collect the request data that includes event information, wager information and the opening bet information, the control process may process that data by at least dividing the data to sets with each set being assigned to be processed by a different parallel processing resource. That is, for example, in the computer system of FIG. 1 which has two GPUs, the wager information will be divided to two equally sized groups with the first group to be assigned to GPU 406 and the second group to be assigned to GPU 408.

In an example embodiments, the opening bet information is received in one or more messages from the wager facilitator. The control process 402 may store the received opening bet information in an opening bet data structure in a memory accessible to the control process 402. The opening bet data structure includes an opening bet for each outcome of the plurality of outcomes of the event. An example opening bet data structure 432 is shown in FIG. 4B.

The wager information may be received at the control process 402 in the form of one or more messages. The received wager information may be stored in the form of one or more a wager data structures. A wager data structure includes one or more wagers and may also include the one or more investment amounts for the included wagers. An example wager data structure 434 is shown in FIG. 4B. The illustrated example wager data structure 434 includes a plurality of wagers 436 and the corresponding investment amounts 438. The one or more wager data structures may include all the wagers of the plurality of wagers that are received by the control process.

At operations 412-416, the event information, wager information and the opening bet information are distributed to the plurality of parallel processing resources in the computer system. Pool configuration information, such as, for example, convergence parameters for the calculation, may also be distributed. At operation 412, process 402 sends the second group of the wager information along with the event information and opening bet information to process 404 which, at operation 414, sends that data to its associated GPU 408. At operation 416, process 402 sends the first group of wager information along with the event information and opening bet information to its associated GPU 406. The operations 412-416, since they distribute respective groups of the wager data among a plurality of parallel processing resources, may be referred to as a scatter operation. In an embodiment, the operations 412-416 utilize an MPI scatter operation (MPI_scatter) to distribute the wager data. More particularly, MPI scatter is used to distribute the wager data to each process which may then make that data available to the respectively associated GPU. FIG. 5 illustrates example wager information and other information distribution by the control processor. FIG. 4B shows an example wager transmittal data structure 440 that is used by the control process 402 to communicate the received wager information to the other processes. The wager transmittal data structure 440 is an example of the wager information communicated from the control processor 402 to the GPU1 406. Whereas the wager data structure 434 may store the wager information in the order received (e.g. ordered sequentially in the order received), the wager transmittal data structure 440 includes wagers in a strided manner of arrangement. Striding of wager information as used in this disclosure is described below in relation to FIG. 5. Briefly, non-adjacent groups of sequentially arranged groups of one or more wagers from the wager data structure 434 are allocated to each group of the plurality of groups of strided wagers. The example wager transmittal data structure 440 includes strided wagers 442 and corresponding strided investments 444. More particularly, the wagers in the wager data structure 434 are divided into two groups of sequentially arranged wager groups: a first group including wager 1 and wager 3, and a second group including wager 2 and wager 4. By striding the wagers from the wager data structure 434, wager 1 and wager 3 are include strided wagers 442 as wager data bound for GPU1. The example of wager transmittal data structure 440 shown in FIG. 4B illustrates a stride size of 1 wager, but embodiments are not limited thereto. The scattering as used in this disclosure, since it results in communicating respective data to respective parallel processing units, may also be referred to as unicasting.

At operations 418 and 420, GPU 406 and 408 respectively perform preprocessing of the received data. Preprocessing converts the received wager information to matrix form. Preprocessing may also provide converting of the received opening bet information and investment information to vector formats. FIG. 6 illustrates an example of preprocessing of wager information.

At operation 422 the GPUs 406 and 408 collaboratively calculate payout data and odds data. FIG. 7 illustrates the calculation operation 422 in more detail. The calculation operation 422 takes as input the respectively grouped input information at each parallel processing resource, at least some of which on each parallel processing resource being preprocessed in operations 418-420, and outputs calculated odds information and/or payout information.

At operation 424, GPU 406 provides the calculated odds information to its associated process 402. At process 426, GPU 408 sends its calculated odds data to its associated process 404 which, at operation 428 transmits that data to control process 402. Operations 424-428, since they collect the odds data calculated at respective processing resources to the control process, may be referred to as a gather operation. In some embodiments, operations 424-428 utilize an MPI gather (MPI_gather) operation. More particularly, each process may retrieve the calculated odds information etc. from a GPU accessible memory and then utilize MPI to provide the calculated information to the control process.

At operation 430, the control process 402 generates a response based on the odds data and/or payout information received from all the parallel processing resources. Subsequently, the generated response is transmitted as an output. FIG. 10 illustrates an example result output of process 400.

Description of FIG. 5

FIG. 5 illustrates an example of input information provided by the control process to the parallel processing resources for use in the pari-mutuel calculation, such as the calculation 422 shown in FIG. 4, according to some example embodiments.

The input information may include calculation parameters 502, investment information 504 and wager information 506. The calculation parameters 502 may include event information. The event information may include the set of fundamental outcomes of the event. The set of fundamental outcomes may be specified in a manner that each column in a one dimensional array will correspond to a predetermined one of the set of possible outcomes, or in a manner that each possible outcome can be mapped to a respective column in a two dimensional array. The calculation parameters may also include pool configuration parameters 118 such as, for example, convergence thresholds etc. Still further, the calculation parameters 502 may also include the set of opening bets. The opening bets may specify, for each possible outcome in the set of possible outcomes, an initial bet amount placed by the wagering association or another entity. The opening bets may be a nominal amount for each fundamental outcome (e.g. a small fraction of a dollar). A non-zero opening bet is specified for each fundamental outcome to, among other aspects, prevent errors due to division by zero. An example of encoding opening bets in an opening bet data structure 432 is shown in FIG. 4B. In some embodiments, the opening bets may be used to weight one possible outcome over the other: for example, opening bets of 0.001 on fundamental outcome 1 and 0.1 on fundamental outcome 2 may represent an expectation that fundamental outcome 2 is 100 times more likely to occur than fundamental outcome 1.

Although not shown specifically, the example event for FIG. 5 may be an event with six outcomes in the set of possible outcomes. The event may be, for example, a three horse race for which the set of possible outcomes define the first two places of the race: (1, 2), (1, 3), (2, 1), (2, 3), (3, 1) and (3, 2), where (x,y) represents horse x and y are in first and second places respectively.

The set of investments 504 and the set of wagers 506 may be obtained from the wager information collected by the control processor before starting the pari-mutuel pool calculation. In the example, the set of wagers 506 comprises four wagers: wager 1, wager 2, wager 3, and wager 4. Each wager specifies a disposition with respect to at least one fundamental outcome in the set of fundamental outcomes. The format for conveying wager information from the control process to the other processes may be a concise format that is different from the format in which the wagers are represented in the parallel processing resources during the calculation. Each of the four shown wagers at the control processor is in the format that allows specifying two choices to win first place and two choices to win second place. A value of 0 in a position represents that the wager is indifferent to the outcome corresponding to that position (i.e. the wager has no bet on that outcome occurring). A positive value in a position represents that for that wager the corresponding outcome is expected to occur (i.e. the wager has a bet on that outcome occurring). In this particular example, a positive value in an element of the wager array identifies a particular horse. Accordingly, wager 1 with the elements "1 0 0 0" is wagering that horse 1 wins first place and is indifferent to which horse comes in second place; wager 2 with "2 0 0 0" is wagering that horse 2 wins first place and is indifferent to which horse comes in second place; wager 3 with "1 2 1 2" is wagering that either horse 1 or 2 will win first place and also that either horse 1 or 2 will win second place; and wager 4 with "1 3 1 3" is wagering that either horse 1 or 3 will win first place and also that either horse 1 or 3 will win second place.

The set of investments 504 consists of an investment associated with each of the wagers 1-4. Thus the example set of investments 504 represent the following investments: 100 value units on wager 1, 100 value units on wager 2, 50 value units on wager 3 and 200 value units on wager 4. A value unit may represent one dollar (or another currency), a predetermined amount of dollars, or a fraction thereof. Wager information arranged in an example wager data structure 434 in a memory is shown in FIG. 4B.

Whereas the pool configuration information, the event information and the opening bet information are broadcast from the control process (e.g. process 402 in FIG. 4) to all the parallel processing resources, the wager information (and the associated investment information) is scattered to the parallel processing resources. In scattering the wager information, the wager information is first logically divided to groups so that each parallel processing resource in the set of parallel processing resources available for the calculation in the computer system is assigned to process at least one of the groups of wager information. In the illustrated example, the wager information is divided to two groups: the first group consisting of the wagers 1 and 3 and the corresponding investments, and the second group consisting of the wagers 2 and 4 and the corresponding investments. The first group is intended for GPU 1 and the second group is intended for GPU 2.

In example embodiments, the data that is to be scattered among the set of available parallel processing resources is strided. For example, rather than sequentially selecting wagers 1 and 2 for group 1 and wagers 3 and 4 for group 2, in the example embodiments wagers 1 and 3 are selected for group 1 and wagers 2 and 4 are selected for group 2. When strided selection is used and multiple parallel processing resources are available, then starting from wager 1, a group of a fixed number (e.g. one) of wagers are selected sequentially for each parallel processing resource before selecting the second group of wagers for any parallel processing resource. Striding the data in this manner has been observed to provide for more even distribution of the calculation in many wagering scenarios. For example, in some embodiments, striding facilitates more even distribution of various different types of wagers among the respective processes in the computing engine.

Different wager types may have different combinations of fundamental outcomes (e.g., some wagers allow winning in a larger subset of fundamental outcomes than other wagers). That means, some wagers may take up more memory in the A-matrix (see below) than others. By having the wagers strided, embodiments may evenly (or substantially evenly) distribute the different types of wagers between the processors. More even distribution of the wagers, may lead to more even use of the memory resources and also the more even distribution of the calculation among the respective processes in the calculation engine. Since typically, input wagers received from bettors are submitted to the calculation engine grouped by type, the striding may provide for substantial improvements in performance by distributing the memory usage and computation workload. In some embodiments, the actual matrix is stored as a sparse matrix (e.g., without storing the zeroes, as a compressed sparse row (CSR)). Since, some matrices can represent thousands, or even millions, of possible outcomes and/or thousands or millions of wagers, an increase in the number of tracked positions in a race (or in multiple races) can exponentially increase the number of the possible outcomes. FIG. 4B shows an example wager data structure 434 in which received wager information is sequentially arranged. FIG. 4B also illustrates a wager transmittal data structure 440 which includes a group of strided wagers 442 and corresponding strided investments 444. The wager transmittal data structure 440 includes wagers that are to be processed by GPU1 from the plurality of wagers. As shown in FIG. 5 in which data for GPU1 is indicated by no fill pattern and data for GPU2 is indicated by the thatch fill pattern, wager 1 and wager 3 are bound for GPU1.

FIG. 5 also shows that after the information is broadcast and scattered as described above, a memory area 508 accessed by process 1 and/or the GPU 1 associated with that process includes the calculation parameters and the first group of wagers (wagers 1 and 3) with corresponding investments, and that a memory area 510 accessed by process 2 and/or the GPU 2 associated with that process includes the calculation parameters and the second group of wagers (wagers 2 and 4) with corresponding investments. In FIG. 5, fill patterns illustrate that the calculation parameters 502 (solid fill) are the same distributed to both processes, the investment information 504 distributes a first portion (no fill pattern) to process 1 and a second portion (thatch fill pattern) to process 2, and the wager array 506 distributes a first portion (no fill pattern) to process 1 and a second portion (thatch fill pattern) to process 2.

Description of FIG. 6

FIG. 6 illustrates an example of preprocessing performed by the processes with received wager information and other information, according to some embodiments. The preprocessing shown in FIG. 6 may be performed during, for example, preprocessing operations 418 and 420 in process 400 shown in FIG. 4. At process 1, for example, the group of wager information and other information received from the control process to be used for the pari-mutuel pool calculation is in the corresponding memory 508 and/or digital storage device. During preprocessing the group of wagers assigned to process 1 and which was received from the control process is formed into matrix form as in matrix 602.

As noted above in relation to FIG. 5, the wager information may be received from the control process in a format that is different from the format for matrix 602. Preprocessing performs the conversion from the format of the received wager information to the format of the matrix 602.

In matrix 602, each wager is represented by a row, and each fundamental outcome of the set of fundamental outcomes is represented by a column. That is, at least according to some embodiments, the columns represent the set of fundamental outcomes for the event. The set of fundamental outcomes for an event is a set of mutually exclusive and a collectively exhaustive set of outcomes of the event for which wagers are accepted. For the example event described above in relation to FIG. 5, the columns of matrix 602 from left to right sequentially may represent the event's set of fundamental outcomes (1, 2), (1, 3), (2, 1), (2, 3), (3, 1) and (3, 2), where (x,y) represents horse x in first place and horse y in second place. The first row in matrix 602 corresponds to the received wager 1 in the format "1 0 0 0" indicating that horse 1 wins first place, and is converted to the matrix 602 format "1 1 0 0 0 0" identifying that this wager is betting on the outcomes (1, 2) or (1, 3). Similarly, the second row in matrix 602 corresponds to the received wager 3 in the format "1 2 1 2" indicating that horses 1 and 2 wins first and second places in either order, and is converted to the matrix 602 format "1 1 0 0 0 0" identifying that this wager is betting on the outcomes (1, 2) or (2, 1). It is observable that, in the above example set of possible outcomes, the six outcomes are mutually exclusive and that collectively cover all combinations of horses 1-3 winning places 1-2 in the race event. As noted above, due to the control process distributing the wager information in a strided manner, process 1 receives wagers 1 and 3 while process 2 receives wagers 2 and 4.

It should be noted that the matrix 602 is part of a larger matrix (referred to as the "A-matrix") distributed across the plurality of parallel processing resources. The larger matrix is the matrix of all wagers and all fundamental outcomes for the event, and the portion 602 of that larger matrix represents only the group of wagers assigned to process 1 by the control process.

The preprocessing may also include forming of the transpose matrix 604 of the matrix 602.

As illustrated in FIG. 6, GPU 1 which is associated with process 1 generates a portion of the A-matrix, and the transpose matrix thereof, based only on wagers 1 and 3. Similarly, other GPUs in the computer system each generates a respective portion of the A-matrix and its transpose.

Description of FIG. 7

FIG. 7 illustrates a calculation process 700 that can be performed during the calculation operation 422 of process 400 shown in FIG. 4, according to some embodiments. More particularly, whereas the event outcomes and wagers associated with an event for which a pari-mutuel pool is formed can be represented as a system of mathematical equations, process 700 provides a iterative technique for finding the roots for the system of mathematical equations thereby providing for determining the solutions (e.g. payout amounts and/or odds for wagers) for the pari-mutuel pool.

Process 700 comprises a starting point calculation 702, more specifically a conjugate descent starting point calculation, to determine starting values for the Newton Conjugate Gradient (CG) technique that is to follow. The starting point calculation 702 is followed by iteratively performing the operations of calculating tolerance 704, calculating the conjugate gradient 706, backtracking line search 708, calculating the move to direction 710, and the checking of convergence 712. Operations 704-712 repeat until a predetermined level of convergence is detected at the check convergence operation 712. When a convergence level that is equal to, or exceeds that of, the predetermined level of convergence is detected at operation 712, the Newton CG technique has arrived at a solution, and the solution to the pari-mutuel pool can be determined.

Figure 8:
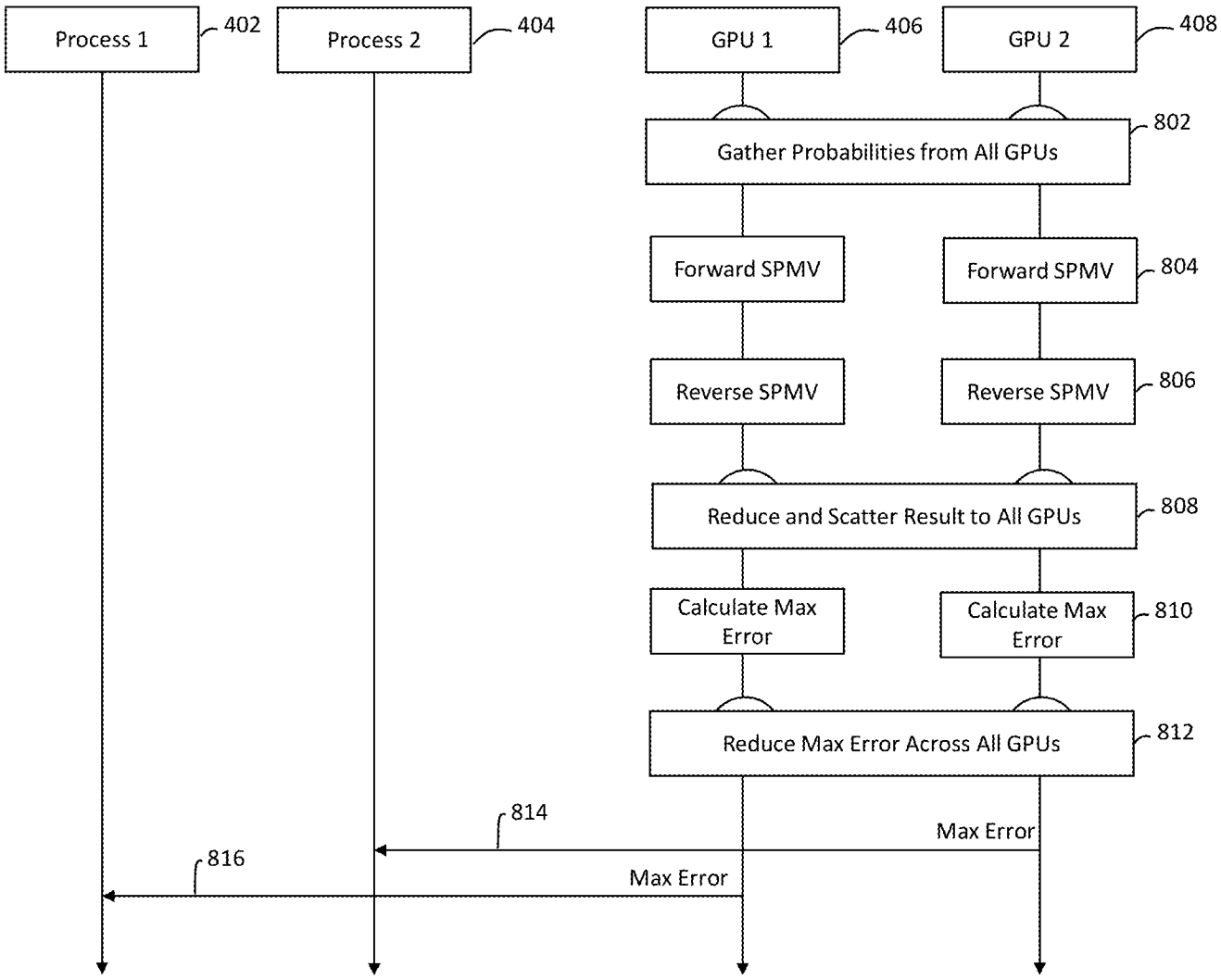
FIG. 8 shows a flowchart for a starting point calculation process to determine initial estimated results for the calculation shown in FIG. 7, according to some embodiments.

Description of FIG. 8

FIG. 8 illustrates a starting point calculation process 800, according to some embodiments. The starting point calculation process 800 may be used for the starting point calculation 702 described above in relation to FIG. 7.

After the starting point calculation process 800 is initiated, at operation 802, each parallel processing resource, or more particularly each GPU in the computer system, collects opening probabilities associated with the set of possible outcomes (as noted above, also referred to as fundamental outcomes) of the event. The opening probabilities may be received at the GPUs in the form of a vector. Alternatively, the opening probabilities may be received in any other format, and are formed by the receiving process into a one-dimensional vector. The vector may be referred to as the vector of outcome probabilities.

Opening bets for each outcome may also be collected. The opening bets correspond to respective value amounts that are bet on each fundamental outcome by the wagering association or another entity. The opening bets may be nominal amounts, for example, a small number of dollars, a fraction of a dollar, a few pennies, or a fraction of a penny. Sometimes the wagering association or other operator may use the opening bets to weight the outcomes (e.g., to even out the outcomes if the operator believes that certain outcomes are much more likely than others). A non-zero opening bet for each of the outcomes may be necessary to prevent dividing by zero during the subsequent calculations.

In the first iteration of the starting point calculation, the vector of outcome opening prices comprises the input opening outcome probabilities. For subsequent iterations, the outcome probabilities calculated by the respective GPUs can be gathered to each GPU so that each GPU has the new probabilities for the fundamental outcomes. Each iteration may be thought of as an independent run with the calculation. Although respective iteration may add newly received wagers, since the pool may not have changed substantially from one iteration to the next, the outcome probabilities from one iteration may be used as the input outcome probabilities for the next iteration. Typically, every iteration of the calculation generates a more accurate answer, and the iteration is restarted with the new outcome probabilities.

The precise magnitude of the opening outcome probabilities may not have an effect on the accuracy of the final results, and may only, if at all, affect the convergence speed of the starting point calculation. The opening outcome probabilities may be assigned in any manner in which the sum of the respective opening outcome probabilities for all the fundamental outcomes is 1. In some embodiments, the opening outcome probability for each fundamental outcome is set as 1 divided by the number of fundamental outcomes.

At operation 804, forward sparse matrix vector multiplication (SPMV) is performed by multiplying the A-matrix 902 with the vector of outcome probabilities 904. As described above, the A-matrix is the matrix of all wagers, and each process (e.g. process 1 and process 2 in the above example) forms a respective portion of the A-matrix during the preprocessing (e.g., operations 418 and 420 described above). As noted above, the vector of outcome probabilities is either received in operation 802 or formed using the opening outcome probabilities information received in operation 802. In implementations, the multiplication operation 804 is the multiplication of a sparse matrix (portion of A-matrix) and a dense vector (opening outcome probabilities). The result of the multiplication operation 804 forward SPMV is a vector of wager probabilities 906 that comprises a calculated probability for each wager in the group of wagers assigned to the calculating GPU. The vector 906 represents wager probabilities. Vector 904, referred to as the vector of outcome probabilities, comprises the probabilities (or prices) of the fundamental outcomes (e.g. 0.2 price means, that you have to spend 20 cents to earn a dollar). The odds of a fundamental outcome is the payout for a dollar on that outcome (e.g. payout amount is the investment of the wager multiplied by the odds for that wager). Vector 910, referred to as the vector of wager payouts, comprises the wager payout for each wager (e.g. row 1 of the A-matrix in FIG. 9A, wager 1, will payout 250 dollars as represented in the first element of vector 910; arrived at by dividing the investment of $100 on wager 1 by the corresponding wager probability of 0.4 in the first element of vector 906).

An example A-matrix 902, an example vector of outcome probabilities 904 and an example resulting vector of wager probabilities 906 are shown in FIG. 9A. FIG. 9A is described below. As shown in FIG. 8 and as described in more detail in relation to FIG. 9A below, each GPU separately performs the multiplication operation 804 on a respective portion of the A-matrix 902 and the entire vector of outcome probabilities 904. At each GPU, the respective portion of the A-matrix processed by that GPU (in the form of the portion of the A-matrix processed by that GPU) includes only the group of wagers assigned to it by the control processor.

At operation 806, reverse SPMV is performed by multiplying the transposed A-matrix 908 with a vector of wager payouts 910. The vector of wager payouts is determined based on the wager amounts (investments) received in the wager information for each wager and on the vector of wager probabilities 906 that resulted from operation 804. The result of the reverse SPMV operation 806 is a vector of outcome payouts 912 at each GPU that performs the multiplication.

An example of the multiplication operation 806 is shown in FIG. 9A. Transposed A-matrix 908 is multiplied by the vector of wager payouts 910 to obtain the vector of outcome payouts 912. As with operation 804, operation 806 is also performed by each GPU separately using its respective portion of the transposed A-matrix 908. Note that each GPU performs the reverse SPMV on a portion of the transposed A-matrix 908 and a portion of the vector of wager payouts 910.

At operation 808, a reduce-and-scatter operation is performed to provide each GPU with the result of operation 806 calculated separately on each of the other GPUs. The reduce-and-scatter operation performs a reduce operation, which sums the outcome payouts from the respective GPUs, followed by a scatter operation, which distributes respective portions of the summed vector to each GPU. The ReduceScatter operation of NCCL can be used to sum the data from each GPU even though the data split across rows and thus distributed over multiple GPUs. Thus, the net effect of operations 806 and 808 is to multiply the transpose of the entire A-matrix, while the A-matrix is distributed by groups of rows (each row corresponding to a respective wager) among respective GPUs, by the vector of wager payouts and obtaining the result of that multiplication, portions of which is then distributed to the respective GPUs.

FIG. 9B illustrates an example reduce-and-scatter operation performed in operation 808. The reduce-and-scatter operation takes as input the vectors of outcome payouts 912 calculated at each GPU with its respective portion of the A-matrix, calculates the sum of these vectors across the GPUs to generate the vector of outcome payout totals 914, portions of which are then scattered (distributed) to respective GPUs. The vector of outcome payout totals 914 comprises a respective total payout for each of the possible outcomes. As shown in FIG. 9B, the six-element vector of outcome payout totals 914 is scattered between the two GPUs such that GPU 1 receives the first three elements and GPU 2 receives the second two elements. The vector of outcome payout totals 914 comprises the payouts, or more particularly the currently estimated payout, for each of the fundamental outcomes of the event.

At operation 808, based on the respective vector of outcome payout totals, each GPU also calculates the odds for the respective fundamental outcomes. FIG. 9B also illustrates an example vector of outcome odds 916 generated on GPU2 based on the vector of outcome payout totals 914 on GPU2. The odds of a particular outcome represents the profit per 1 value unit of premium (or investment) paid. Thus the odds for a particular one of the fundamental outcomes $o_i$ can be calculated as the total premium in the pool minus the total premium on the particular outcome $o_i$, divided by the total premium on the particular outcome. The odds is the inverse of the probability.

At operation 810, each GPU calculates the maximum payout error. The payout error is the difference between all the investment in and all the payout (for any outcome). This is determined outcome by outcome. Equilibrium is detected when the total payout is the same amount (or within a preconfigured margin of error) of the total investment taken in. The relationship between vectors 906 and 910: vector 910 is the raw investment for each wager divided by the probability for that wager; e.g. $100 on wager 1, divided by 0.4 results in $250 (the payout for wager 1) that is shown in 910. Each GPU initially determines its maximum payout error among the event outcomes in its portion of the vector of outcome payout totals 914.

At operation 812, all GPUs collaborate to reduce the maximum error across all GPUs. Each GPU shares its determined maximum payout error with all the other GPUs. An NCCL AllReduce operation on the maximum payout error would provide each GPU with the maximum payout error values determined individually by each of the respective GPUs. In an AllReduce operation, each of K processors determines its maximum error from among N values from every processor into an output of dimension K*N. The output is ordered by rank index (a process/processor identifier). At this point, all GPUs individually have access to the maximum payout errors of each of the other GPUs, and therefore, the system maximum payout error that is determined by every GPU will be the same.

FIG. 9C illustrates each of GPU1 and GPU2 determining, based on its vector of outcome payout totals, the maximum payout error 918 on the respective GPU and then subsequent to the AllGather operation determining the system maximum payout error 920 which is the maximum payout error for the system in that iteration. Thus, all GPUs have the errors calculated by all other GPUs and would arrive at the same maximum error value. With the AllReduce operation at this stage, the idea is to have one single value which is the maximum error across all outcomes; that is the condition under which the calculation can exit.

At operations 814 and 816, GPU 2 (408) sends its maximum error to its associated process 2 (404) and GPU 1 (406) sends its maximum error to its associated process 1 (402).

Description of FIG. 9 (FIGS. 9A, 9B and 9C)

FIG. 9A illustrates an example of the multiplication of the A-matrix 902 by the vector of outcome probabilities 904. For clarity of illustration, matrix or vector elements that are only on the GPU 1 are illustrated without a fill pattern, elements that are only on GPU 2 are illustrated a thatch fill pattern, and elements that are on both GPU 1 and GPU 2 are illustrated with a dotted fill pattern.

The A-matrix 902 is formed such that each row of the matrix represents a wager, and each column of the matrix represents a respective outcome from the set of fundamental outcomes of the event in association with which the wagers are being placed. The set of possible outcomes represented in the columns of the A-matrix may constitute all the outcomes on which wagers are accepted for the event.

Although the A-matrix 902 is shown as a single matrix, the first two rows of the matrix (indicated without fill pattern) are on GPU 1 and the last two rows (indicated with thatch fill pattern) are on GPU 2. The vector 904 is on GPU 1 and GPU 2.

The multiplication operation is performed by the first two rows of the matrix being multiplied by the vector 904 on GPU 1, and the last two rows of the matrix being multiplied by the vector 904 on GPU 2.

As shown the result of the multiplication is a vector of wager opening bet prices 906. The vector 906 is an n element vector, with element i (i=1 to n) corresponding to the $i^{th}$ wager.

Since, in this operation, GPU 1 and GPU 2 each performs the matrix vector multiplication only of a respective portion of the A-matrix, the resulting vector 906 comprises some elements on each of GPU 1 and GPU 2 as illustrated with the fill patterns.

Thus, generalizing the above, with n being the number of wagers and m being the size of the set of possible outcomes, the A-matrix is a n×m matrix of n rows and m columns. The vector of outcome probabilities provides a probability for each outcome in the set of possible outcomes (that is, for each fundamental outcome) and thus is a vector of m elements (also referred to as an m×l matrix). Based on standard matrix multiplication behavior, the size of the result is an n element vector (also referred to as a n×l matrix).

The transposed A-matrix 908 is then multiplied by the vector of wager payouts 910. The vector of wager payouts 910 is an n element vector derived from vector of wager probabilities 906 and wager amounts for each of the n wagers. The respective values for elements of the vector of wager payouts 910 is determined by dividing the investment in the corresponding wager by the value of the corresponding element in the vector of wager probabilities 906.

The result of the multiplication of the transposed A-matrix 908 by the vector of wager payouts 910 is the vector of outcome payout totals 912. Since GPU 1 and GPU 2 each performs this multiplication only on a respective portion of the transposed A-matrix 908 and a respective portion of the vector of wager payouts 910, only a respective portion (indicated by the respective fill patterns) of the vector of outcome payout totals 912 is generated on each of GPU 1 and GPU 2.

FIG. 9B illustrates an example of the reduce-and-scatter (e.g. using the ReduceScatter operation of NCCL) operation performed by respective GPUs in the computer system to determine the vector of outcome payout totals based on the information calculated on the respective GPUs. This operation enables the summing of all the vectors of outcome payouts 912 generated on respective GPUs to generate the vector of outcome payout totals 914. The vector of outcome payout totals 914 is, by the reduce-and-scatter operation, distributed to the respective GPUs such that each GPU receives only a portion (as indicated by the fill pattern in FIG. 9B) of the vector of outcome payout totals 914. The vector of outcome payout totals 914 is an m element vector in which the $j^{th}$ (j=l to m) represents the current notional payout, determined based on the customer wagers (investments) and the opening bets, of the $j^{th}$ outcome in the set of possible outcomes (set of fundamental outcomes).

At each GPU, state calculations are performed based on the respective portions of the vector of outcome payout totals 914 to determine the odds for each outcome of the set of possible outcomes thus generating the vector of outcome odds 916. Each element in the vector of outcome odds 916 is obtained by dividing the value of the corresponding element in the vector of outcome payout totals 914 by the total investments in the pool.

FIG. 9C illustrates an example of the maximum error determination based on the calculations performed on respective GPUs. In this example, the maximum error being determined is that of the current calculated total prices of the respective outcomes in the set of possible outcomes. However, example embodiments are not limited to determining maximum error in the total payouts of the respective outcomes, and the maximum error may be determined for any one or more relevant iteratively calculable metrics such as, for example, total prices of the respective outcomes, odds of the respective outcomes, odds of the respective wagers, etc.

GPU 1 and GPU 2 each independently determines the maximum error 918 in the portion (as indicated by the different fill patterns) of its vector of outcome payout totals 914. In some embodiments, the error for a particular outcome is the difference between the current payout for that outcome and the total investment. The total investment may in some instances, in addition to the wager investments, also include the opening bets. Then, each of the independently determined maximum errors 918 are distributed to all GPUs. An operation such as a gather operation, for example, the AllGather operation in NCCL, can be used for the distribution. In this manner each GPUs have the respective maximum error determinations from all other GPUs, and can determine the system maximum payout error 920 among all GPUs.

Description of FIG. 10

FIG. 10 illustrates a Newton Conjugate Gradient (Newton-CG) process 1000, in accordance with some embodiments. The process 1000 may be performed by the computer system of FIG. 1 or 2 when performing operations 706-712 shown in FIG. 7.

At operation 1002, process 1, and at operation 1004, process 2, each calculates a conjugate gradient tolerance (CG tolerance) based on the system maximum payout error 920 received from its respective associated GPU at operations 814-816. The Newton-CG may be considered to comprise two iterative algorithms—on the outside is the Newton algorithm and on the inside, to find the Newton direction, the conjugate gradient algorithm is used. Operations 1002-1004 address finding the CG tolerance for use in the CG part of the algorithm at the respectively associated GPUs. The CG tolerance is another condition for exiting the algorithm—and is determined based on the current system maximum error 920. Operation 1010 is the beginning of the outer loop (Newton algorithm), and process 1100 is the inner iteration (CG algorithm). Process 1100 entirely occurs within operation 1010. The CG tolerance calculated in 1002-1004 is provided to the inner loop as the stopping tolerance. The outer loop is stopped based on the parameters sent in, the convergence, and/or payout error (e.g., system maximum error being within a predetermined threshold).

At operations 1006-1008, their respectively calculated CG tolerance and other information for performing the iterative process 1010-1014, are provided by process 1 and process 2 to GPU 1 and GPU 2 respectively.

In operations 1010-1014, the GPUs collaborate to improve upon the current vector of outcome payout totals by modifying starting outcome probabilities, according to a convergence technique. The convergence technique in this embodiment is Newton-CG technique, and, in some embodiments, the operations 1002-1014 collectively may be considered as forming a Newton CG iteration.

At operation 1010, the Newton direction for the conjugate gradient is calculated. This operation is described in more detail in FIG. 11. Process 1100 shown in FIG. 11 represents one or more CG iterations that may be required for each iteration of the operations 1010. More, particularly, FIG. 11 represents an implementation of the Preconditioned Conjugant Gradient method to solve for the Newton direction. The Newton direction represents the direction of movement (e.g. the adjustments to be made to the inputs for the next iteration) in the next step of the overall iteration (outer iteration shown in FIG. 10) that brings the calculation closer to the equilibrium convergence criteria that all of the investment (within a margin of tolerance) into the pool is paid out to the winning wagers. Each CG iteration requires a step size coefficient ($a_k$) and a direction ($\zeta_k$) for the CG vector. This is represented below where direction $d_k$ is the output of the CG, in this case the Newton Direction.

$$d_{k+1}=d_k+a_k\zeta_k$$

At operation 1012, a line search, such as, for example, a backtracking line search, is performed to choose the step size which minimizes the function.

At operation 1014, the move to Newton direction is calculated based on the determinations obtained in operations 1010 and 1012. That is, in this operation, the vector of outcome probabilities that is to be taken as input to the next iteration is updated in accordance with the Newton Direction determined in operation 1012-1014. In some embodiments, a fixed step size with which to iterate in its search for a root may be used.

After operation 1014, the processing may revert to operation 1002-1004 to begin another iteration of the Newton Conjugate operations. The determination of the convergence of the maximum system payout may not be limited to the use of the Newton-CG method. Other techniques, such as, for example, Broydon-Fletcher-Goldfard-Shanno (BFGS) and Limited Memory BFGS (LBFGS) may be used alternatively.

Description of FIG. 11

FIG. 11 illustrates a conjugate gradient process 1100, in accordance with some embodiments. The process 1100 may be performed by the computer system of FIG. 1 or 2 when, for example, performing operation 1010 shown in FIG. 10. As noted above, FIG. 11, or more specifically, the process 1100, represents an implementation of the Preconditioned Conjugant Gradient method to solve for the Newton direction that is to be provided to an iteration of the Newton algorithm being performed by process 1000 and shown in FIG. 10.

At operation 1102, each GPU gathers conjugate gradient vectors (CG vectors), which in this application are the vectors to be used as the vector of outcome probabilities in the next iteration, from all other GPUs. At the beginning of this operation, each GPU has a portion of the vector of outcome probabilities for the next iteration. The update is to move the vector of outcome payouts towards convergence. At operation 1102, a gather operation is performed to collect all portions of the vector of outcome probabilities. Each GPU may form a respective CG vector for the current iteration. Operation 1102 is the initial step of the CG iteration. The goal of FIG. 11, achieved by operations 1102-1108, is to multiply the CG vector by the Hessian Matrix which is part of the overall process of finding the step size ($a_k$) for the next iteration. The initial CG vector is the result of dividing the residual ($r_k$) and the preconditioner (in this case the diagonal of the Hessian Matrix). Also, initially the residual ($r_k$) is the gradient of the longitude equilibrium. In other words, the residual is the current difference between the investment into the pool and the payout at each outcome (payout error) which is used when checking the overall convergence criteria.

At operation 1104, forward SPMV is performed. In a manner similar to that described in relation to operation 804, the A-matrix 902 is multiplied by the CG vector which.

At operation 1106, backward SPMV is performed. In this operation, in a manner similar to operation 806 above, the transposed A-matrix is multiplied by the vector of wager payouts. The vector of wager payouts is determined based upon the vector of wager probabilities generated by operation 1104. The result of operation 1106 is a vector of values.

At operation 1108, a reduce-and-scatter operation is performed. In this operation, similar to that described in relation to operation 808, a reduce-and-scatter is performed to sum the calculated values from the respective GPUs to generate the vector of outcome payout totals, followed by the scatter operation, which distributes portions of the operation's results to each GPU.

At operation 1110, the GPUs collaborate to calculate a scalar product. The Scalar Product (also known as the Dot Product) is the sum of the multiplication of the elements of two vectors. This is a step of the Conjugate Gradient method which takes the Scalar Product of the CG vector and the result of the multiplication in operation 1102. From this scalar output the step size ($a_k$) is calculated. The calculated scalar product is the step size that should be used to adjust the CG Vector in the next iteration.

At operations 1112-1114 each GPU transmits the calculated scalar product to the associated process. Operations 1112-1114 may be performed in a manner similar to operations 814-816 described above.

At operation 1116 the processes 1 and 2 respectively calculates an alpha value. The calculated alpha value corresponds to an adjustment or a step size, determined based on the conjugate gradient tolerance as described in relation to operations 1002-1004 above, by which to adjust the current CG vector.

At operations 1118-1120 each process transmits the calculated alpha to the respectively associated GPUs. After the step size ($a_k$) is calculated it is applied to the CG vector. This is the operation 1118 of FIG. 11. After this step is applied the residual is calculated in step 1120. The residual is the current payout error and is a measure of how correct the current solution/newton direction is. On each iteration the residual is checked with the tolerance calculated in FIG. 10 1002/1004 and the CG exits when the residual is less than the tolerance.

At operation 1122, each GPU updates the calculated direction. Lastly in step 1122 the next CG vector ($z_k$) is calculated from the preconditioner and the new residual. That takes the form like below:

$$z_{(k+1)}=y_{(k+1)}+\beta_{(k+1)}z_k$$

Where β is a coefficient calculated from the new residual and $y_{k+1}$ is the new residual ($r_k$) divided by the preconditioner (diagonal of the Hessian Matrix) stated above.

Description of FIG. 12

FIG. 12 illustrates an example of the results from process 400, in accordance with some embodiments. The outputs at process 1 and process 2, based on the outputs from obtained from GPU 1 and GPU2 respectively, are shown in the memory 1202 of process 1 and the memory 1204 of process 2. The outputs received from each GPU comprises wager odds and event outcome probabilities (corresponding to per event outcome prices or payouts) calculated by that GPU. Process 1, as the control process, then receives the calculated results from all other processes and at operation 430 aggregates the outputs from the other processes to generate the results 1206.

Because the wager information provided as input to the parallel processing resources was distributed in a strided manner, the outputs corresponding to the wager odds correspond to that strided distribution pattern. Thus, the odds for wagers 1 and 3 are from GPU 1 and odds for wagers 2 and 4 are received from GPU 2. The event outcome probabilities are calculated by the respective GPUs based on the event outcome information distributed to the GPUs by a reduce-and-scatter operation, and thus the result vector of event outcome probabilities is sequentially divided evenly into portions provided by each respective GPU.

Figure 13A:
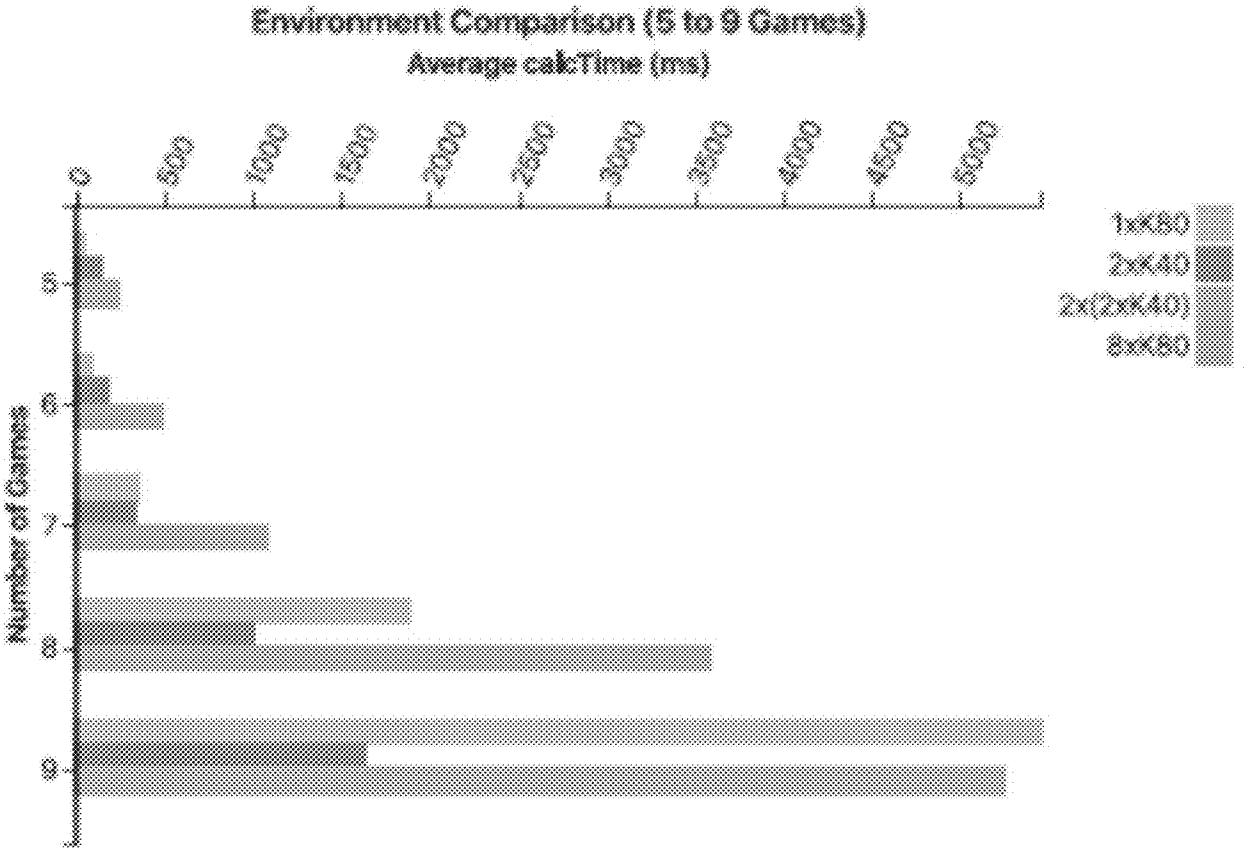
FIG. 13A and FIG. 13B (collectively FIG. 13) illustrate examples of the performance improvements provided by some embodiments.
Figure 13B:
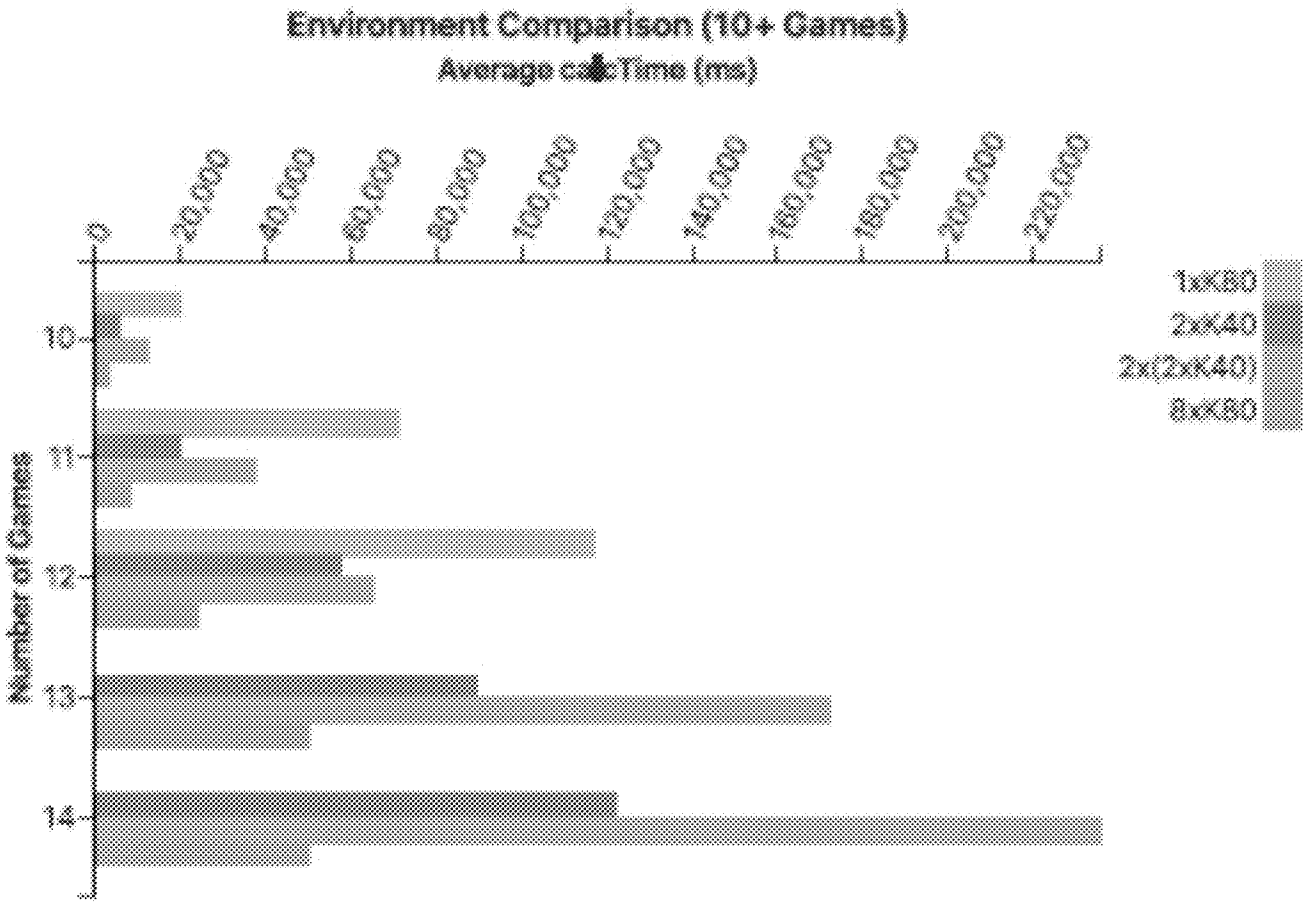
Figure 14:
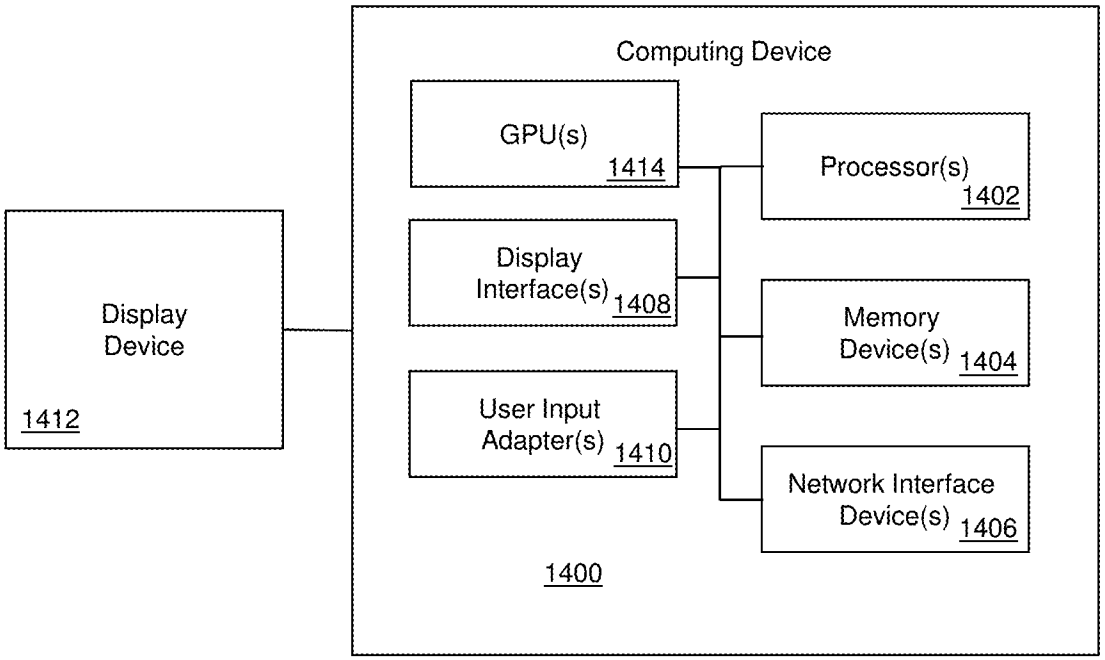
FIG. 14 schematically illustrates a computer that can be used to implement the pari-mutuel pool calculation shown in FIG. 4 and the software architecture shown in FIG. 3, according to some example embodiments.

Description of FIG. 13 (FIGS. 13A and 13B)

FIG. 13 illustrates examples of the performance improvements provided by some embodiments.

FIG. 13A charts the average pari-mutuel pool calculation time in milliseconds on the x-axis, and the number of games in the event in the y-axis. The number of games in the event directly impacts the size of the set of possible outcomes. In some embodiments, an increase in the number of games result in an exponential increase in the number of outcomes and the number of wagers. On the y-axis, for each number of games, the performance is shown for three different computer system configurations: specified from the top to lowest in each group—1 GPU in one computer, 2 GPU in 1 computer, and 2 GPU each in 2 computers.

It can be seen that, for the smaller sizes (5-6 games) of the set of possible outcomes, the single GPU computer performs substantially more efficiently (e.g. least average calculation time) than both the 2 GPU computer systems. In the 7 game scenario the single GPU computer system is only slightly less efficient than the computer with 2 GPU, but in 8 and 9 game scenarios the computer with the 2 GPUs is increasingly substantially more efficient than the single GPU computer. The 2 computers each with 2 GPUs is relatively inefficient in all the scenarios with 5-9 games.

In FIG. 13B, On the y-axis, for each number of games, the performance is shown for three or four different computer system configurations: specified from the top to lowest in each group—1 GPU in one computer, 2 GPU in 1 computer, 2 GPU each in 2 computers, and 8 GPU in 1 computer.

The number of games charted range from 10-14 games. It can be seen that for the resulting sizes of the sets of possible outcomes, the computer with the 8 GPUs is substantially more efficient than the other computer system configurations.

The illustrates results show that the tradeoff between the inter-communication overhead incurred to communicate between multiple processors and/or GPUs, and the size of the data set should be considered in order to obtain the best performance.

Description of FIG. 14

FIG. 14 schematically illustrates a computer that can be used to implement the pari-mutuel calculation engine and associated processes described above in relation to FIGS. 1-12 according to some example embodiments. In particular, the computing device 1400 can be used to implement the servers in the server system and/or client devices of FIG. 1, the servers in FIG. 2, and to run the process described in relation to FIGS. 3-4, 7-8 and 10-11, according to some example embodiments. FIG. 14 is a block diagram of an example computing device 1400 (which may also be referred to, for example, as a "computing device," "computer system," or "computing system") according to some embodiments. In some embodiments, the computing device 1400 includes one or more of the following: one or more processors 1402 (which may also be referred to as "hardware processors" or individually as a "hardware processor"); one or more memory devices 1404; one or more network interface devices 1406; one or more display interfaces 1408; one or more user input adapters 1410; and one or more graphics processing units (GPU) 1414. Additionally, in some embodiments, the computing device 1400 is connected to or includes a display device 1412. As will explained below, these elements (e.g., the processors 1402, memory devices 1404, network interface devices 1406, display interfaces 1408, user input adapters 1410, GPU 1414, display device 1412) are hardware devices (for example, electronic circuits or combinations of circuits) that are configured to perform various different functions for the computing device 1400.

In some embodiments, each or any of the processors 1402 is or includes, for example, a single- or multi-core processor, a microprocessor (e.g., which may be referred to as a central processing unit or CPU), a digital signal processor (DSP), a microprocessor in association with a DSP core, an Application Specific Integrated Circuit (ASIC), or a Field Programmable Gate Array (FPGA) circuit. And/or, in some embodiments, each or any of the processors 1402 uses an instruction set architecture such as x86 or Advanced RISC Machine (ARM).

In some embodiments, each or any of the memory devices 1404 is or includes a random access memory (RAM) (such as a Dynamic RAM (DRAM) or Static RAM (SRAM)), a flash memory (based on, e.g., NAND or NOR technology), a hard disk, a magneto-optical medium, an optical medium, cache memory, a register (e.g., that holds instructions), or other type of device that performs the volatile or non-volatile storage of data and/or instructions (e.g., software that is executed on or by processors 1402).

In some embodiments, each or any of the network interface devices 1406 includes one or more circuits (such as a baseband processor and/or a wired or wireless transceiver), and implements layer one, layer two, and/or higher layers for one or more wired communications technologies (such as, for example, Ethernet (IEEE 802.3)) and/or wireless communications technologies (such as Bluetooth, WiFi (IEEE 802.11), GSM, CDMA2000, UMTS, LTE, LTE-Advanced (LTE-A), LTE Pro, Fifth Generation New Radio (5G NR) and/or other short-range, mid-range, and/or long-range wireless communications technologies). A transceiver may comprise circuitry for a transmitter and a receiver. In some embodiments, the transmitter and receiver of a transceiver may share a common housing and may share some or all of the circuitry in the housing to perform transmission and reception. In some embodiments, the transmitter and receiver of a transceiver may not share any common circuitry and/or may be in the same or separate housings.

In some embodiments, each or any of the display interfaces 1408 is or includes one or more circuits that receive data from the processors 1402, generate (e.g., via a discrete GPU, an integrated GPU, a CPU executing graphical processing, or the like) corresponding image data based on the received data, and/or output (e.g., a High-Template Multimedia Interface (HDMI), a DisplayPort Interface, a Video Graphics Array (VGA) interface, a Digital Video Interface (DVI), or the like), the generated image data to the display device 1412, which displays the image data. Alternatively or additionally, in some embodiments, each or any of the display interfaces 1408 is or includes, for example, a video card, video adapter, or GPU.

In some embodiments, each or any of the user input adapters 1410 is or includes one or more circuits that receive and process user input data from one or more user input devices (not shown in FIG. 14) that are included in, attached to, or otherwise in communication with the computing device 1400, and that output data based on the received input data to the processors 1402. Alternatively or additionally, in some embodiments each or any of the user input adapters 1410 is or includes, for example, a PS/2 interface, a USB interface, a touchscreen controller, or the like; and/or the user input adapters 1410 facilitates input from user input devices (not shown in FIG. 10) such as, for example, a keyboard, mouse, trackpad, touchscreen, etc.

In some embodiments, the display device 1412 may be a Liquid Crystal Display (LCD) display, Light Emitting Diode (LED) display, or other type of display device. In embodiments where the display device 1412 is a component of the computing device 1400 (e.g., the computing device and the display device are included in a unified housing), the display device 1412 may be a touchscreen display or non-touchscreen display. In embodiments where the display device 1412 is connected to the computing device 1400 (e.g., is external to the computing device 1400 and communicates with the computing device 1400 via a wire and/or via wireless communication technology), the display device 1412 is, for example, an external monitor, projector, television, display screen, etc.

In some embodiments, each GPU 1414 may be an off-the-shelf processor or a custom processor that includes numerous processing cores (e.g., hundreds or thousands of cores) and thereby is particularly well suited for parallel processing applications in the model of single instruction multiple data (SIMD) or single instruction multiple thread (SIMT). Each GPU 1414 is particularly well suited for graphics-related tasks, and are also particularly well suited for any high performance compute tasks that, for example, require operations (e.g., matrix multiplication, etc.) on large matrices.

The computing device 1400 may be arranged, in various embodiments, in many different ways. In various embodiments, the computing device 1400 includes one, or two, or three, four, or more of each or any of the above-mentioned elements (e.g., the processors 1402, memory devices 1404, network interface devices 1406, display interfaces 1408, user input adapters 1410, and GPU 1414). Alternatively or additionally, in some embodiments, the computing device 1400 includes one or more of: a processing system that includes the processors 1402; a memory or storage system that includes the memory devices 1404; and a network interface system that includes the network interface devices 1406. Alternatively or additionally, in some embodiments, the computing device 1400 includes a system-on-a-chip (SoC) or multiple SoCs, and each or any of the above-mentioned elements (or various combinations or subsets thereof) is included in the single SoC or distributed across the multiple SoCs in various combinations. For example, the single SoC (or the multiple SoCs) may include the processors 1402, the GPUs 1414 and the network interface devices 1406; or the single SoC (or the multiple SoCs) may include the processors 1402, GPUs 1414, the network interface devices 1406, and the memory devices 1404; and so on. Further, the computing device 1400 may be arranged in some embodiments such that: the processors 1402 include a multi (or single)-core processor; the network interface devices 1406 include a first (short-range) network interface device (which implements, for example, WiFi, Bluetooth, NFC, etc.) and a second (long-range) network interface device that implements one or more cellular communication technologies (e.g., 3G, LTE, LTE-A, 5G NR, etc.); and the memory devices 1404 include a RAM and a flash memory). The processor, the first network interface device, the second network interface device, and the memory devices may be integrated as part of the same SOC (e.g., one integrated circuit chip). As another example, the computing device 1400 may be arranged in some embodiments such that: the processors 1402 include two, three, four, five, or more multi-core processors; the network interface devices 1406 include a first network interface device that implements Ethernet and a second network interface device that implements WiFi and/or Bluetooth; and the memory devices 1404 include a RAM and a flash memory or hard disk.

As previously noted, whenever it is described in this document that a software module or software process performs any action, the action is in actuality performed by underlying hardware elements according to the instructions that comprise the software module/process. Consistent with the foregoing, in various embodiments, each or any combination of the pari-mutuel pool calculation 116, pool configuration storage 118, event information 126, wager information 128, opening bet information 130, Java communication layer 302, calculation library 304, listener and worker processes shown in FIG. 3B, etc., each of which will be referred to individually for clarity as a "component" for the remainder of this paragraph, are implemented using an example of the computing device 1400 of FIG. 14. In such embodiments, the following applies for each component: (a) the elements of the computing device 1400 shown in FIG. 14 (i.e., the one or more processors 1402, one or more memory devices 1404, one or more network interface devices 1406, one or more display interfaces 1408, one or more user input adapters 1410, and one or more GPUs 1414), or appropriate combinations or subsets of the foregoing) are configured to, adapted to, and/or programmed to implement each or any combination of the actions, activities, or features described herein as performed by the component and/or by any software modules described herein as included within the component; (b) alternatively or additionally, to the extent it is described herein that one or more software modules exist within the component, in some embodiments, such software modules (as well as any data described herein as handled and/or used by the software modules) are stored in the memory devices 1404 (e.g., in various embodiments, in a volatile memory device such as a RAM or an instruction register and/or in a non-volatile memory device such as a flash memory or hard disk) and all actions described herein as performed by the software modules are performed by the processors 1402 in conjunction with, as appropriate, the other elements in and/or connected to the computing device 1400 (i.e., the network interface devices 1406, display interfaces 1408, user input adapters 1410, GPUs 1414 and/or display device 1412); (c)

alternatively or additionally, to the extent it is described herein that the component processes and/or otherwise handles data, in some embodiments, such data is stored in the memory devices 1404 (e.g., in some embodiments, in a volatile memory device such as a RAM and/or in a non-volatile memory device such as a flash memory or hard disk) and/or is processed/handled by the processors 1402 in conjunction, as appropriate, the other elements in and/or connected to the computing device 1400 (i.e., the network interface devices 1406, display interfaces 1408, user input adapters 1410, GPUs 1414 and/or display device 1412); (d) alternatively or additionally, in some embodiments, the memory devices 1404 store instructions that, when executed by the processors 1402, cause the processors 1402 to perform, in conjunction with, as appropriate, the other elements in and/or connected to the computing device 1400 (i.e., the memory devices 1404, network interface devices 1406, display interfaces 1408, user input adapters 1410, GPUs 1414 and/or display device 1412), each or any combination of actions described herein as performed by the component and/or by any software modules described herein as included within the component.

The hardware configurations shown in FIG. 14 and described above are provided as examples, and the subject matter described herein may be utilized in conjunction with a variety of different hardware architectures and elements. For example: in many of the Figures in this document, individual functional/action blocks are shown; in various embodiments, the functions of those blocks may be implemented using (a) individual hardware circuits, (b) using an application specific integrated circuit (ASIC) specifically configured to perform the described functions/actions, (c) using one or more digital signal processors (DSPs) specifically configured to perform the described functions/actions, (d) using the hardware configuration described above with reference to FIG. 14, (e) via other hardware arrangements, architectures, and configurations, and/or via combinations of the technology described in (a) through (e).

Description of Example Mathematical Processing for Pari-Mutuel Pools

Every outcome of an event for which a pari-mutuel pool is set up can be represented by a fundamental outcome or by a combination of fundamental outcomes. Similarly, every wager in the pari-mutuel pool can be represented by a fundamental bet or a combination of fundamental bets. The ability to represent wagers with fundamental bets enables different types of wagers to be represented in the same pari-mutuel pool.

In determining the final fills and final odds, the wagering association may seek to maximize the total filled premium M, that is, to pay out all or substantially all (within a margin of tolerance) of the investments received from bettors for the event, subject to several constraints. An example maximization process that may be used in example embodiments of this disclosure can be mathematically represented as follows:

Maximize M, subject to $$0 < p_s \quad s = 1, 2, \ldots, S \tag{1}$$

$$\sum_{s=1}^{S} p_s = 1 \tag{2}$$

-continued $$\pi_j = \prod_{s=1}^{S} a_{j,s} p_s \quad j = 1, 2, \ldots, J \tag{3}$$

$$\omega_j < o_j \rightarrow v_j = 0;\ \omega_j = o_j \rightarrow 0 \le v_j \le u_j;\ \omega_j > o_j \rightarrow v_j = u_j \tag{4}$$

$$M \equiv \left(\sum_{j=1}^{J} v_j\right) + \sum_{s=1}^{S} \theta_s \tag{5}$$

$$y_s \equiv \sum_{j=1}^{J} a_{j,s} x_j \quad s = 1, 2, \ldots, S \tag{6}$$

$$y_s + \frac{\theta_s}{p_s} = M \quad s = 1, 2, \ldots, S \tag{7}$$

Let S denote the number of fundamental outcomes associated with the types of wagers allowed by the wagering association. Let s index the fundamental outcomes, so s=1, 2, . . . , S. Each fundamental outcome is associated with a fundamental bet, where the $s^{th}$ fundamental bet pays out $1 if and only if the $s^{th}$ fundamental outcome occurs.

Exactly one fundamental bet will payout based on the underlying event, since the fundamental outcomes are a mutually exclusive and collectively exhaustive set of outcomes. The number of fundamental bets is equal to S, the number of fundamental outcomes, and the fundamental bets may also be indexed by s with s=1, 2, . . . , S.

Before the wagering association accepts bets during the betting period, the wagering association may enter bets for each of the S fundamental outcomes referred to as the opening bets. Let the $s^{th}$ opening bet payout if and only if the $s^{th}$ fundamental outcome occurs, and let $\theta_s$ be the amount of that opening bet for s=1, 2, . . . , S. Some embodiments require that a non-zero opening bet is specified for each fundamental outcome.

In an example embodiment, the winning outcomes from a bet can be related to specific fundamental outcomes. For j=1, 2, . . . , J, let $a_j$ be a 1 by S row vector where the $s^{th}$ element of $a_j$ is denoted by $a_{j,s}$. Here, $a_{j,s}$ is proportional to bet j's requested payout if fundamental outcome s occurs. If $a_{j,s}$ is 0, then the bettor requests no payout if fundamental outcome s occurs. If $a_{j,s}$ is greater than 0, then the bettor requests a payout if fundamental outcome s occurs. For simplicity, $a_j$ may be such that the minimum $a_{j,s}$ for any j is 0, and the maximum is 1. The vector $a_j$ may be referred to as the weighting vector for wager j.

Let $p_s$ denote the final price of the $s^{th}$ fundamental bet with a payout of $1. Based on the price for a $1 payout, the odds for that fundamental bet are $(1/p_s)-1$ to 1.

In equations (1) and (2) above, the wagering association requires that the prices of the fundamental bets are positive and sum to one.

The wagering association may determine the price of each wager using the prices of the fundamental bets as follows. Let $\pi_j$ denote the final price for a $1 payout for wager j. For simplicity of exposition, assume here that the wagering association does not charge fees. Then, the price for wager j is specified as in (3) above.

The price of a wager is the weighted sum of the prices of the fundamental bets applicable to that wager. The final odds to $1 for bet j are given by co, $=(1/\pi_j)-1$. For notation, let J be the number of bets made by bettors in the betting period. Let $o_j$ denote the limit odds per $1 of premium bet for j=1, 2, . . . , J. Let $u_j$ denote the premium amount requested if bet j is a premium bet. Once the filled premium $v_j$ is determined for the premium bet, the filled payout $x_j$ for this bet can be computed by the formula $x_j=v_j/\pi_j$. Equation (4) above relates $\omega_j$, $o_j$, $v_j$, and $u_j$.

Let M denote the total premium paid in the betting period, which can be computed as in equation (5). Here, $y_s$ the aggregate filled amount across all bets that payout if fundamental outcome s occurs. Next, note that $a_{j,s}x_j$ is the amount of fundamental bets used to create bet j. Equation (6) relates the aggregate filled amount $y_s$ and $a_{j,s}x_j$.

The self-hedging condition is the condition that the total premium collected is exactly sufficient to fund the payouts to winning bettors. The self-hedging condition can be written as in (7). The wagering association takes on risk to the underlying wagering only through profit or loss in the opening bets. Equation (7) relates $y_s$, the aggregated filled amount of the $s^{th}$ fundamental bet, and $p_s$, the price of the S fundamental bet. For M and $\theta_s$ fixed, the greater $y_s$, then the higher $p_s$ and the higher the prices (or equivalently, the lower the odds) of bets that pay out if the $s^{th}$ fundamental bet wins. Similarly, the lower the bet payouts $y_s$, then the lower $p_s$ (or equivalently, the higher the odds) and the lower the prices of bets that pay out if the $s^{th}$ fundamental bet wins. Thus, in this pricing framework, the demand for a particular fundamental bet is closely related to the price for that fundamental bet.

In determining the final fills and the final odds, the wagering association may seek to maximize the total filled premium M subject to the constraints described above. Based on this maximization, the wagering association determines the final fills and the final odds. During the betting period, the wagering association can display indicative odds and indicative fills calculated based on the assumption that no more bets are received during the betting period.

Technical Advantages of Described Subject Matter

Certain example embodiments provide improved speed and support larger data sets for pari-mutuel pool calculations. The improved speed is obtained by improved utilization of multiple processing resources in a computer system, and the improved speed enables the computer system to have improved response times to queries and also to update statuses associated with the pari-mutuel pool in a real-time or near real-time manner as changes occur to the pool.

The support for the larger data sets enable use of pari-mutuel pools for events with larger sets of possible outcomes, and for a larger number of wagers.

The improved speed and the support for larger sizes of wagering pools is obtained by improved utilization of multiple processing resources in a computer system. The embodiments operate by partitioning input data to be distributed throughout the computer system and combining intermediate result data calculated by the respective processors of the computer system in such a way that the calculation is spread throughout the computer system in an efficient manner, thereby yielding performance improvements in faster response times and ability to process larger data sets. For example, embodiments provide for grouping wager data and providing for the respective groups of wager data to be processed at respective associated processing resources in the computer system in a highly efficient manner using associated data such as investment amounts and opening bet data that are locally available at the respective associated processing resources available, while also utilizing inter-communication among the processing resources efficiently by providing for intermediate results from the respective processing resources to be distributed among the processing resources at some stages during the pari-mutuel calculation or for the intermediate results from all processing resources to be combined and then redistributed to the respective processing resources for further calculation of the pari-mutuel pools based on all the wager data. Moreover, embodiments may provide for allocating the groups of wager data to each of the available respective processing resources in a manner that yields a more balanced distribution of the workload (e.g. of the different types of wagers) among the respective processing resources.

Selected Terminology

Whenever it is described in this document that a given item is present in "some embodiments," "various embodiments," "certain embodiments," "certain example embodiments, "some example embodiments," "an exemplary embodiment," or whenever any other similar language is used, it should be understood that the given item is present in at least one embodiment, though is not necessarily present in all embodiments. When it is described in this document that an action "may," "can," or "could" be performed, that a feature or component "may," "can," or "could" be included in or is applicable to a given context, that a given item "may," "can," or "could" possess a given attribute, or whenever any similar phrase involving the term "may," "can," or "could" is used, it should be understood that the given action, feature, component, attribute, etc. is present in at least one embodiment, though is not necessarily present in all embodiments. Terms and phrases used in this document, and variations thereof, unless otherwise expressly stated, should be construed as open-ended rather than limiting. As examples of the foregoing: "and/or" includes any and all combinations of one or more of the associated listed items (e.g., a and/or b means a, b, or a and b); the singular forms "a", "an" and "the" should be read as meaning "at least one," "one or more," or the like; the term "example" is used provide examples of the subject under discussion, not an exhaustive or limiting list thereof; the terms "comprise" and "include" (and other conjugations and other variations thereof) specify the presence of the associated listed items but do not preclude the presence or addition of one or more other items; and if an item is described as "optional," such description should not be understood to indicate that other items are also not optional.

As used herein, the term "non-transitory computer-readable storage medium" includes a register, a cache memory, a ROM, a semiconductor memory device (such as a D-RAM, S-RAM, or other RAM), a magnetic medium such as a flash memory, a hard disk, a magneto-optical medium, an optical medium such as a CD-ROM, a DVD, or Blu-Ray Disc, or other type of device for non-transitory electronic data storage. The term "non-transitory computer-readable storage medium" does not include a transitory, propagating electromagnetic signal.

The claims are not intended to invoke means-plus-function construction/interpretation unless they expressly use the phrase "means for" or "step for," and claim elements intended to be construed/interpreted as means-plus-function language, if any, will expressly manifest that intention by using the phrase "means for" or "step for"; the foregoing applies to elements in all types of claims (method claims, apparatus claims, or claims of other types) and, for the avoidance of doubt, also applies to apparatus elements nested in method claims. Consistent with the preceding sentence, no claim element (in any claim of any type) should be construed/interpreted using a means plus function construction/interpretation unless the element is expressly recited using the phrase "means for" or "step for."

Whenever it is stated herein that a hardware element (e.g., a processor, network interface, memory, or other hardware element), or combination of hardware elements, is "configured to" perform some action, it should be understood that such language specifies an actual state of configuration of the hardware element(s), rather than a mere intended use of the hardware element(s). The actual state of configuration fundamentally ties the action recited following the "configured to" phrase to the physical characteristics of the hardware element(s) recited before the "configured to" phrase. In some embodiments, the actual state of configuration may include a processor, such as, for example, an application specific integrated circuit (ASIC) that is designed for performing the action or a field programmable gate array (FPGA) that has logic blocks configured to perform the action. In some embodiments, the actual state of configuration of the hardware elements is a particular configuration of registers and memory that may be caused by a processor executing or loading program code stored in a memory or storage device of a combination of hardware elements. A hardware element (or elements) can be understood to be configured to perform an action even when the specified hardware element(s) is/are not currently operational (e.g., is not on). Consistent with the preceding paragraph, the phrase "configured to" in claims should not be construed/interpreted using a means plus function construction/interpretation.

Additional Applications of Described Subject Matter

The example embodiments described above concerned an electronic system for pari-mutuel pool calculation. However, it should be noted that embodiments are not limited to pari-mutuel wagering of the types that were described above. Embodiments may provide for systems and methods for hedging against or otherwise making investments in any contingent claims relating to events of economic significance, where the contingent claims are contingent in that their payout or return depends on the outcome of an observable event with more than one possible outcome. Example embodiments maybe used in any of the applications described in U.S. Pat. No. 7,842,972 dated U.S. Pat. No. 7,742,972 and U.S. Pat. No. 8,275,695 dated Sep. 25, 2012 and which use pari-mutuel pools.

Although process steps, algorithms or the like may be described or claimed in a particular sequential order, such processes may be configured to work in different orders. In other words, any sequence or order of steps that may be explicitly described or claimed does not necessarily indicate a requirement that the steps be performed in that order. The steps of processes described herein may be performed in any order possible. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the technology, and does not imply that the illustrated process is preferred.

While the technology has been described in connection with what is presently considered to be the most practical and preferred embodiment, it is to be understood that the technology is not to be limited to the disclosed embodiment, but on the contrary, is intended to cover various modifications and equivalent arrangements.

The invention claimed is:

1. A system comprising:

a control processor; and a plurality of parallel processing units communicatively connected to the control processor, each parallel processing unit comprising a graphics processing unit (GPU), wherein the control processor is configured to:

obtain, from message data received from a requesting device, an opening bet data structure comprising a plurality of opening bets, the plurality of opening bets comprising a respective opening bet on each outcome of an event having a plurality of outcomes;

store one or more wager data structures in a memory, the one or more wager data structures comprising a plurality of wagers associated with the event and a respective investment amount for each wager of the plurality of wagers in a pari-mutuel pool;

divide the plurality of wagers to a plurality of groups of wagers, the number of groups in the plurality of groups of wagers being determined based on the number of parallel processing units in the plurality of parallel processing units, wherein the dividing includes allocating non-adjacent groups of sequentially arranged groups of one or more wagers from the one or more wager data structure to respective groups of the plurality of groups of wagers;

associate each group of wagers of the plurality of groups of wagers with a respective parallel processing unit of the plurality of parallel processing units;

broadcast the opening bet data structure to the plurality of parallel processing units;

unicast data comprising respective groups of the plurality of groups of wagers and the corresponding investment amounts to each of said parallel processing units;

receive at least one of odds data or payout amounts for each said group of wagers from the respective parallel processing units;

generate a response based on the received at least one of odds data or payout data; and transmit the generated response to the requesting device.

2. The system according to claim 1, wherein the control processor is further configured to perform, between the unicasting data comprising respective groups of wagers and the receiving at least one of odds data or payout data, operations comprising:

receiving payout error information from a plurality of the respective parallel processing units, the payout error information being determined based on the respective group of wagers associated with each said parallel processing unit;

calculate an error tolerance based on the received payout error information and a predetermined tolerance threshold; and transmit an adjustment parameter based on the calculated error tolerance to said plurality of parallel processing units.

3. The system according to claim 2, wherein the control processor is further configured to perform, in response to receiving another payout error information determined by a first calculation process on the plurality of the respective parallel processing units, calculating another error tolerance and transmitting another adjustment parameter based on the calculated another error tolerance to a second calculation process on the plurality of the respective parallel process units, the second calculation process being executed after the first calculation process.

4. The system according to claim 1, wherein each parallel processing unit of the plurality of parallel processing units is configured to:

receive a respective group of wagers, corresponding investment amounts, and the plurality of opening bets;

perform a preprocessing of the respective group of wagers, corresponding investment amounts and the plurality of opening bets, wherein the preprocessing includes generating a matrix of wagers based on the group of wagers and a transposed matrix of said wagers;

calculate, on a GPU associated with said each parallel processing unit, the at least one of odds data or the payout data based on at least the preprocessed respective group of wagers by performing a first multiplication of the matrix of wagers with a first vector and a second multiplication of the transposed matrix of wagers with a second vector that is determined based on a result of the first multiplication; and transmit the calculated at least one of odds data or payout data for said respective group of wagers.

5. The system according to claim 4, wherein the calculating the at least one of odds data or the payout data based on at least the preprocessed group of wagers, comprises:

calculating intermediate at least one of odds data or payout data based at least on the first and second multiplication, wherein the first vector comprises opening probabilities for each of the plurality of outcomes; and generating the at least one of odds data or payout data by repeatedly adjusting the intermediate odds data based on an iterative convergence process.

6. The system according to claim 5, wherein the iterative convergence process comprises repetitively performing until a predetermined level of convergence occurs:

calculating an error of the adjusted intermediate at least one of odds data or payout data;

calculating a conjugate gradient associated with the adjusted intermediate at least one of odds data or payout data and an error tolerance that is based on the calculated error;

generating another set of intermediate at least one of odds data or payout data based upon a line search; and determining convergence of the another set of intermediate at least one of odds data or payout data.

7. The system according to claim 5, wherein the calculating an error comprises:

calculating a component of the error based on the received respective group of wagers; and determining the error based on the component of the error and one or more other components of the error received from others of the parallel processing units.

8. The system according to claim 4, wherein said calculate the at least one of odds data or the payout data comprises performing a gather operation to aggregate values calculated on respective GPUs and a scatter operation to distribute the aggregated values to the respective GPUs.

9. The system according to claim 4, wherein the preprocessing comprises:

forming an A×B matrix from the respective group of wagers and a B×1 matrix from a plurality of opening probabilities, wherein A is the number of wagers in the respective group of wagers and B is the number of outcomes of the event; and forming a B×A matrix by transposing the A×B matrix, and wherein the calculating at least one of odds data or payout data comprises:

calculating an A×1 matrix of prices for the respective group of wagers by matrix multiplying the A×B matrix and the B×1 matrix; and calculating a B×1 matrix of estimated payouts based on the B×1 matrix of prices and the corresponding investments associated with the respective group of striped wagers.

10. The system according to claim 9, wherein the preprocessing comprises converting the wagers from a first format of the received wagers to a second format used in the A×B matrix.

11. The system according to claim 1, wherein said plurality of parallel processing units each comprises a respective GPU an associated respective process executing on the control processor.

12. The system according to claim 1, wherein said plurality of parallel processing units each comprises a respective GPU and a respective CPU.

13. The system according to claim 1 configured to used NCCL for inter-GPU communication and MPI for communicating between processes associated with respective GPUs.

14. A method performed by a control processor of a system comprising a plurality of parallel processing units communicatively connected to the control processor, each parallel processing unit comprising a graphics processing unit (GPU), the method comprising:

obtaining, from message data received from a requesting device, an opening bet data structure comprising a plurality of opening bets, the plurality of opening bets comprising a respective opening bet on each outcome of an event having a plurality of outcomes;

storing one or more wager data structures in a memory, the one or more wager data structures comprising a plurality of wagers associated with the event and a respective investment amount for each wager of the plurality of wagers in a pari-mutuel pool;

dividing the plurality of wagers to a plurality of groups of wagers, the number of groups in the plurality of groups of wagers being determined based on the number of parallel processing units in the plurality of parallel processing units, wherein the dividing includes allocating non-adjacent groups of sequentially arranged groups of one or more wagers from the one or more wager data structure to respective groups of the plurality of groups of wagers;

associating each group of wagers of the plurality of groups of wagers with a respective parallel processing unit of the plurality of parallel processing units;

broadcasting the opening bet data structure to the plurality of parallel processing units;

unicasting data comprising respective groups of the plurality of groups of wagers and the corresponding investment amounts to each of said parallel processing units;

receiving odds data and payout data for each said group of wagers from the respective parallel processing units;

generating a response based on the received odds data and payout data; and transmitting the generated response, to the requesting device.

15. A method performed on each parallel processing unit of a plurality of parallel processing unit in a system comprising a control processor and the plurality of parallel processing units, the method comprising:

obtaining, from message data received from a requesting device, an opening bet data structure comprising a plurality of opening bets, the plurality of opening bets comprising a respective opening bet on each outcome of an event having a plurality of outcomes;

storing one or more wager data structures in a memory, the one or more wager data structures comprising a plurality of wagers associated with the event and a respective investment amount for each wager of the plurality of wagers;

dividing the plurality of wagers to a plurality of groups of wagers, the number of groups in the plurality of groups of wagers being determined based on the number of parallel processing units in the plurality of parallel processing units, wherein the dividing includes allocating non-adjacent groups of sequentially arranged groups of one or more wagers from the one or more wager data structure to respective groups of the plurality of groups of wagers;

associating each group of wagers of the plurality of groups of wagers with a respective parallel processing unit of the plurality of parallel processing units;

broadcasting the opening bet data structure to the plurality of parallel processing units;

unicasting data comprising respective groups of the plurality of groups of wagers and the corresponding investment amounts to each of said parallel processing units receiving at least one of odds data or payout amounts for each said group of wagers from the respective parallel processing units;

generating a response based on the received at least one of odds data or payout data; and transmitting the generated response to the requesting device.

16. A non-transitory computer readable storage medium having stored therein instructions that, when executed by a control processor of a system for processing a pari-mutuel pool associated with an event, cause the control processor to perform operations comprising:

obtaining, from message data received from a requesting device, an opening bet data structure comprising a plurality of opening bets, the plurality of opening bets comprising a respective opening bet on each outcome of an event having a plurality of outcomes;

storing one or more wager data structures in a memory, the one or more wager data structures comprising a plurality of wagers associated with the event and a respective investment amount for each wager of the plurality of wagers;

dividing the plurality of wagers to a plurality of groups of wagers, the number of groups in the plurality of groups of wagers being determined based on the number of parallel processing units in a plurality of parallel processing units, wherein each parallel processing unit is connected to the control processor and comprises a graphics processing unit (GPU), and wherein the dividing includes allocating non-adjacent groups of sequentially arranged groups of one or more wagers from the one or more wager data structure to respective groups of the plurality of groups of wagers;

associating each group of wagers of the plurality of wagers with a respective parallel processing unit of the plurality of parallel processing units;

broadcasting the opening bet data structure to the plurality of parallel processing units;

unicasting data comprising respective groups of the plurality of groups of wagers and the corresponding investment amounts to each of said parallel processing units;

receiving at least one of odds data or payout amounts for each said group of wagers from the respective parallel processing units;

generating a response based on the received at least one of odds data or payout data; and transmitting the generated response to the requesting device.

* * * * *